US010112746B2

(12) United States Patent
Crosby

(10) Patent No.: US 10,112,746 B2
(45) **Date of Patent: *Oct. 30, 2018**

(54) DETACHABLE DISPENSING SYSTEMS FOR CONTAINERS

(71) Applicant: FunLPro Technology LLC, Oak Ridge, TN (US)

(72) Inventor: Bryan Justin Robert Crosby, Maryville, TN (US)

(73) Assignee: GBS Holdings LLC, Oak Ridge, TN (US)

( * ) Notice: Subject to any disclaimer, the term of this patent is extended or adjusted under 35 U.S.C. 154(b) by 83 days.

This patent is subject to a terminal disclaimer.

(21) Appl. No.: 15/377,000

(22) Filed: Dec. 13, 2016

(65) Prior Publication Data

US 2017/0088317 A1 Mar. 30, 2017

Related U.S. Application Data

(63) Continuation of application No. 14/663,654, filed on Mar. 20, 2015, now Pat. No. 9,550,606.

(51) Int. Cl.
*B67D 3/00* (2006.01)
*B67D 7/06* (2010.01)
(Continued)

(52) U.S. Cl.
CPC ..... *B65D 47/063* (2013.01); *B65D 25/48* (2013.01); *B65D 47/0885* (2013.01)

(58) Field of Classification Search
CPC .... B65D 47/63; B65D 25/48; B65D 47/0885; B65D 47/61; B65D 25/46
(Continued)

(56) References Cited

U.S. PATENT DOCUMENTS 1,473,925 A 11/1923 Dryer
1,595,231 A 8/1926 Dryer
(Continued)

FOREIGN PATENT DOCUMENTS

DE 9111483 U1 1/1992
EP 0353043 A2 1/1990
(Continued)

OTHER PUBLICATIONS

International Search Report and Written Opinion for International Application No. PCT/US2013/035878 dated Jun. 10, 2013.
(Continued)

*Primary Examiner* — Jeremy W Carroll
(74) *Attorney, Agent, or Firm* — Eversheds Sutherland (US) LLP

(57) ABSTRACT

Detachable dispensing systems for containers are provided that include a handling portion having an outer ring configured to selectively secure and, alternatively, remove the handling portion about a dispensing opening of the container and an inner ring defining a circular aperture within the handling portion, a hollow rigid member slideably disposed within the circular aperture and selectively positionable between a recessed position and, alternatively, an extended position, and an extendible spout at least partially disposed in the hollow rigid member and connected to the hollow rigid member, in which the extendible spout is configured to dispense a pourable material from the container through the distal opening when the handling portion is engaged about the dispensing opening of the container. Material containers are also provided that include a container having a dispensing opening and the detachable dispensing system selectively connected to the container about the dispensing opening.

36 Claims, 16 Drawing Sheets

(51) Int. Cl.
*B65D 47/06* (2006.01)
*B65D 25/48* (2006.01)
*B65D 47/08* (2006.01)

(58) Field of Classification Search
USPC ..... 222/530, 538, 539, 527
See application file for complete search history.

(56) References Cited

U.S. PATENT DOCUMENTS

| | | | | |
|---|---|---|---|---|
| 2,344,505 | A | 3/1944 | Eckman | |
| 3,063,604 | A * | 11/1962 | Malpas | B65D 47/061 222/525 |
| 3,372,846 | A | 3/1968 | Berkus | |
| 3,659,757 | A | 5/1972 | Tini | |
| 3,865,270 | A | 2/1975 | Petersson | |
| 4,076,151 | A | 2/1978 | Littlefield | |
| 4,311,259 | A | 1/1982 | Babiol | |
| 4,426,027 | A | 1/1984 | Maynard, Jr. | |
| 4,452,382 | A | 6/1984 | Van Holdt | |
| 4,560,081 | A | 12/1985 | Adams | |
| 4,650,096 | A | 3/1987 | Thatcher | |
| 5,048,728 | A | 9/1991 | Gomez Acevedo | |
| 5,088,632 | A * | 2/1992 | Odet | B65D 47/063 222/529 |
| 5,607,086 | A | 3/1997 | Gooch | |
| 6,006,961 | A | 12/1999 | Wark | |
| 6,112,949 | A | 9/2000 | Rhodes et al. | |
| 6,386,405 | B1 | 5/2002 | Kars et al. | |
| 7,980,431 | B1 | 7/2011 | Barksdale | |
| 9,056,699 | B2 | 6/2015 | Crosby | |
| 9,550,606 | B2 | 1/2017 | Crosby | |
| 2003/0011194 | A1 | 1/2003 | Arch | |
| 2007/0278256 | A1 | 12/2007 | Law et al. | |
| 2009/0212079 | A1 | 8/2009 | Baughman et al. | |
| 2013/0270307 | A1 * | 10/2013 | Crosby | B65D 47/063 222/530 |

FOREIGN PATENT DOCUMENTS

| | | | |
|---|---|---|---|
| EP | 1864915 | A2 | 12/2007 |
| EP | 2371730 | A1 | 10/2011 |
| EP | 2641842 | A1 | 9/2013 |
| FR | 2388730 | A1 | 11/1978 |
| FR | 2895732 | A1 | 7/2007 |
| WO | 00/16668 | A1 | 3/2000 |

OTHER PUBLICATIONS

International Search Report and Written Opinion for International Patent Application No. PCT/US2016/022305 dated May 20, 2016 (11 pages).

* cited by examiner

DETACHABLE DISPENSING SYSTEMS FOR CONTAINERS

CROSS-REFERENCE TO RELATED APPLICATIONS

This application is a continuation of U.S. patent application Ser. No. 14/663,654, filed on Mar. 20, 2015, which is incorporated herein by reference in its entirety.

TECHNICAL FIELD

The present disclosure relates generally to dispensing systems, more particularly, to detachable dispensing systems for containers.

BACKGROUND

Typically, when transferring fluids from a container, it is necessary either to attach a pouring spout to the container or to insert a funnel into the receiving vessel to prevent unwanted spillage. Such transfer methods are commonly used to deliver fluids such as motor oil, antifreeze, transmission fluid, and gasoline additives to an automobile. A common problem when using transfer devices such as a pouring spout or a funnel to transfer such fluids is that they frequently become contaminated, particularly if they are used with some sticky substance such as oil, coolant, and the like. As a result, a user must locate, clean, and dry the transfer device prior to each use to avoid contamination of the fluid during transfer to the receiving vessel. The user must also select a transfer device of an appropriate size and shape to enable the transfer of fluids without spillage. However, many of the known transfer devices are not adapted to fit closely to the mouth of the container from which the fluid is poured, thus spills are frequent when either the spout or container is inadvertently moved, resulting in an inconvenience to the user for having to clean up the spill or a detrimental environmental impact in the case of oils and coolants leaking into the ground. Nor do many of the known transfer devices enable closed fluid transfer in which the fluid is transferred from the container to a receiving vessel or area without being exposed to the environment.

It therefore would be desirable to provide detachable dispensing systems for containers that are capable of ameliorating some or all of the foregoing disadvantages. In particular, it would be desirable to provide detachable dispensing systems that facilitate efficient, clean, and protected transfer of pourable materials from a container.

SUMMARY

In one aspect, detachable dispensing systems for a container are provided. In one embodiment, the detachable dispensing system includes a handling portion having an outer ring configured to selectively secure and, alternatively, remove the handling portion about a dispensing opening of the container and an inner ring defining a circular aperture within the handling portion, a hollow rigid member that includes a top end and a base end, and an extendible spout that is at least partially disposed in and connected to the hollow rigid member, in which the extendible spout is configured to dispense a pourable material from the container through the distal opening when the handling portion is engaged about the dispensing opening of the container. The hollow rigid member is slideably disposed within the circular aperture and selectively positionable between a recessed position in which the top end is proximate the handling portion and the base end extends away from the handling portion and toward the container and, alternatively, an extended position in which the base end is proximate the handling portion and the top end extends away from the handling portion and the container. The top end of the hollow rigid member includes a first engaging element for engaging at least a portion of the inner ring of the handling portion and preventing the top end of the hollow rigid member from moving through the handling portion into the container when the hollow rigid member is in the recessed position. The base end of the hollow rigid member includes a second engaging element for engaging at least a portion of the inner ring of the handling portion and fixing the hollow rigid member to the handling portion when the hollow rigid member is in the extended position. The extendible spout includes a proximal end and a proximal opening, a distal end and a distal opening, and a discharge passage that extends from the proximal opening to the distal opening, in which the proximal end is connected to the hollow rigid member and the distal end is configured to extend from and retract at least partially into the hollow rigid member.

In another aspect, material containers are provided. In one embodiment, the material container includes a container having a dispensing opening and a detachable dispensing system, as described above, that is selectively connected to the container about the dispensing opening.

DETAILED DESCRIPTION

Figure 1:
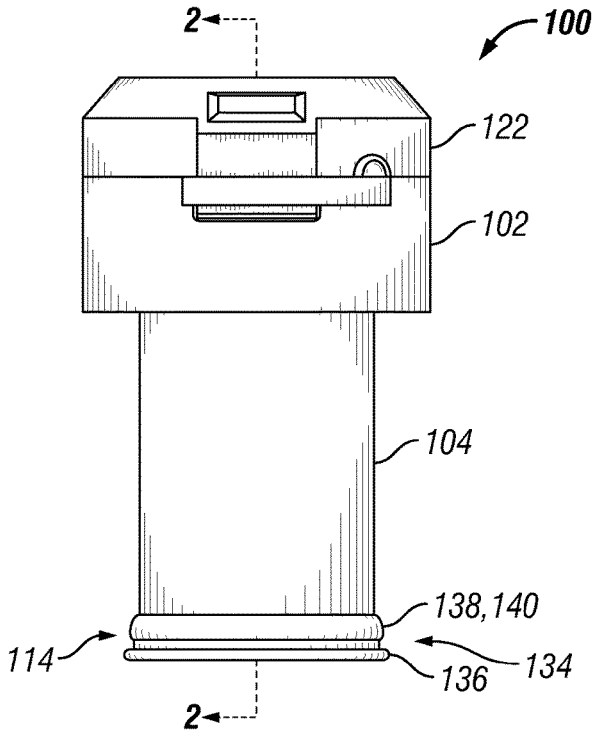
FIG. 1 is a side elevation view of a detachable dispensing system with a hollow rigid member in a recessed position, an extendible spout in a retracted configuration, and a lid in a closed position in accordance with an embodiment of the present disclosure.

The present invention is described in detail in connection with various embodiments for purposes of illustration only. Parameters of different steps, components, and features of the embodiments are described separately, but may be combined consistently with this description of claims, to enable other embodiments as well to be understood by those skilled in the art. Various terms used herein are likewise defined in the description which follows.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself.

Detachable dispensing systems for containers have been developed that generally include a handling portion, a hollow rigid member, and an extendible spout. The features of the detachable dispensing systems described herein beneficially enable easy and selective attachment and removal of the detachable dispensing systems from a container when desired, rather than between each use, while also providing the ability to efficiently dispense the container contents into receiving vessels or areas not otherwise easily accessible with conventional transfer devices and method. Further, the features of the detachable dispensing systems described herein also beneficially provide the ability to directionally transfer pourable material from a container into a receiving vessel or area without exposing such material to the environment during transfer.

Detachable Dispensing Systems

In embodiments, the detachable dispensing systems described herein include a handling portion having an outer ring and an inner ring. The inner ring defines a circular aperture within the handling portion. The outer ring is configured to selectively secure and, alternatively, remove the handling portion about a dispensing opening of the container. That is, the outer ring connects the handling portion to the container. The outer ring configuration advantageously enables the handling portion, and thus the system, to be attached to and removed from the container, when desired, rather than being permanently attached. As a result, the systems described herein can be repeatedly used with the same container or other containers, thereby allowing the containers to be resealed with its initial lid and/or seal after each allotment of pourable materials via the system or the container may be discarded. This feature minimizes contamination and spillage of the pourable material within the container between each allotment. The outer ring configuration also beneficially secures the system to the container so that unwanted spillage of the pourable material is minimized, if not avoided, during use and to prevent the pourable material of the container to be exposed to the environment when being dispensed therefrom.

As used herein, "dispensing opening" is an opening in a container that provides access to the contents therein. In some embodiments, the dispensing opening is covered or closed with an initial lid and/or seal that is/are subsequently removed prior to connecting the detachable dispensing system to the container. In other embodiments, the dispensing opening may be formed by a user by way of, for example, making a puncture or cut in the container body. In yet other embodiments, the dispensing opening may be covered or sealed with a detachable dispensing system described herein that is prepackaged together with, and connected about the dispensing opening of, the container during manufacture.

In some embodiments, the handling portion is made of a thermoplastic material. Non-limiting examples of suitable thermoplastic materials include polypropylene, polyethylene, and the like.

In some embodiments, the handling portion is formed by injection molding.

In embodiments, the detachable dispensing systems described herein also include a hollow rigid member that includes a top end and a base end. The hollow rigid member is slideably disposed within the circular aperture and selectively positionable between a recessed position and an extended position. These features of the hollow rigid member beneficially prevents the system from having to be removed from the container after each use and further avoids subjecting the container contents to potential contamination or spillage. Further, the recessed position advantageously allows the container to retain a similar overall size and shape when engaged with the systems described herein, which is not otherwise possible with the use of conventional dispensing systems (e.g., funnels, pouring spouts, and the like). Additionally, the extended position allows the system to dispense substantially all, if not all, the pourable material of the container without trapping material within the container that would have otherwise been dispensed from the container without such system.

As used herein, "slideably disposed" means that the hollow rigid member is freely moveable through the circular aperture unless otherwise fixed to the handling portion when in a recessed position or an extended position.

As used herein, "selectively positionable" when used to describe the hollow rigid member means capable of being moved and positioned, e.g. by a user, from a recessed position to an extended position and vice versa at desired times.

In some embodiments, the hollow rigid member is made of a thermoplastic material. Non-limiting examples of suitable thermoplastic materials include polypropylene, polyethylene, and the like.

In some embodiments, the hollow rigid member is formed by injection molding.

The hollow rigid member is in a recessed position when the top end is proximate the handling portion and the base end extends away from the handling portion and toward the container, as illustrated, for example, in FIGS. 1, 3, 8, 10, 15, and 20. The top end includes a first engaging element for engaging at least a portion of the inner ring of the handling portion and preventing the top end of the hollow rigid member from moving through the handling portion into the container when the hollow rigid member is in the recessed position. That is, once the hollow rigid member is engaged with the inner ring, via the first engaging element, the hollow rigid member is stabilized in the recessed position and therefore unable to separate from the system and completely emerge into the container. In operation, when the hollow rigid member is in a recessed position, at least a portion of the hollow rigid member may be disposed within the container. As such, the diameter of the hollow rigid member at least along the portion that extends between the top and end portion is less than the diameter of the dispensing opening of the container.

The hollow rigid member is in an extended position when the base end is proximate the handling portion and the top end extends away from the handling portion and the container, as illustrated, for example, in FIGS. 5, 7, 12, 14, 17, 19, 22, and 24. The base end includes a second engaging element for engaging at least a portion of the inner ring of the handling portion and fixing the hollow rigid member to the handling portion when the hollow rigid member is in the extended position. That is, once the hollow rigid member is engaged with the inner ring, via the second engaging element, the hollow rigid member is stabilized in the extended position and therefore unable to move through the circular aperture to regress into or further out of the container.

In operation when the hollow rigid member is in the extended position, the base end of the hollow rigid member, in some embodiments, may be substantially flush with the dispensing opening of the container, whereas in other embodiments, the base end may be substantially flush with the inner ring of the handling portion. As used herein, the term "flush" when used to describe the position of the base end of the hollow rigid member in relation to another component of the detachable dispensing system means immediately adjacent to or directly abutting such component. In an embodiment, when the hollow rigid member is in the extended position, the hollow rigid member may be partially disposed within the container. For example, in one embodiment, at least a portion of the base end of the hollow rigid member may be partially disposed within the container above the fill line for the pourable material.

In some embodiments, the second engaging element includes first one or more peripheral elements extending outwardly from the hollow rigid member proximate the base end for engaging the inner ring of the handling portion and fixing the hollow rigid member to the handling portion when the hollow rigid member is in the extended position.

In some embodiments where the second engaging element includes first one or more peripheral elements, the hollow rigid member is selectively positionable from the recessed position to the extended position by pulling the top end of the hollow rigid member in a direction away from the handling portion and sliding the hollow rigid member into engagement with the first one or more peripheral elements. In these embodiments, the hollow rigid member may also be selectively positionable from the extended position to the recessed position by applying force to the top end in a direction towards the handling portion and sliding the hollow rigid member out of engagement with the first one or more peripheral elements.

In some embodiments, the first engaging element includes second one or more peripheral elements extending outwardly from the hollow rigid member proximate the top end for engaging the inner ring of the handling portion and fixing the hollow rigid member to the handling portion when the hollow rigid member is in the recessed position. In one embodiment, where the first engaging element includes the second one or more peripheral elements, the second engaging element includes the first one or more peripheral elements.

In some embodiments where the first engaging element includes second one or more peripheral elements, the hollow rigid member is selectively positionable from the recessed position to the extended position by pulling the top end in a direction away from the handling portion, disengaging the inner ring of the handling portion from the second one or more peripheral elements, and sliding the hollow rigid member into engagement with the first one or more peripheral elements. In these embodiments, the hollow rigid member may also be selectively positionable from the extended position to the recessed position by applying force to the top end in a direction towards the handling portion, sliding the hollow rigid member out of engagement with the first one or more peripheral elements, and engaging the inner ring of the handling portion with the second one or more peripheral elements.

In some embodiments, the second engaging element includes a first flange extending outwardly from the hollow rigid member proximate the base end and first one or more snapping elements extending outwardly from the hollow rigid member proximate the base end and spaced inwardly from the first flange for engaging the base end of the hollow rigid member with the inner ring of the handling portion between the first flange and the first one or more snapping elements and retaining the hollow rigid member in the extended position with a snap interference fit. That is, in operation, the base end engages with the inner ring by having the hollow rigid member slide through the inner ring such that the inner ring slides over the first one or more snapping elements and interacts with the first flange causing the inner ring to rest between the first flange and the first one or more snapping elements. In one embodiment, the first one or more snapping elements include an annular ring.

As used herein, a "snap interference fit" means a stationary coupling of the hollow rigid member to the inner ring as a result of at least one or more snapping elements.

In embodiments where the second engaging element includes the first flange and the first one or more snapping elements, the first engaging element, in some embodiments, includes second one or more threads proximate the top end for engaging the inner ring of the handling portion and fixing the hollow rigid member to the handling portion when the hollow rigid member is in the recessed position. In certain embodiments, the first engaging element also includes a second flange extending outwardly from the hollow rigid member proximate the top end.

In embodiments where the second engaging element includes the first flange and the first one or more snapping elements and the first engaging element includes the second one or more threads, the hollow rigid member may be selectively positionable from the recessed position to the extended position by threadably disengaging the inner ring of the handling portion from the top end, pulling the top end in a direction away from the handling portion, and sliding the hollow rigid member into engagement with the second engaging element. The hollow rigid member may also be selectively positionable from the extended position to the recessed position by applying force to the top end in a direction towards the handling portion, sliding the hollow rigid member out of engagement with the second engagement element, and threadably engaging the inner ring to the top end of the hollow rigid member.

In some embodiments, the first engaging element includes a second flange extending outwardly from the hollow rigid member proximate the top end and second one or more snapping elements extending outwardly from the hollow rigid member proximate the top end and spaced inwardly from the second flange for engaging the top end of the hollow rigid member with the inner ring of the handling portion between the second flange and the second one or more snapping elements and retaining the hollow rigid member in the recessed position with a snap interference fit. That is, in operation, the top end of the hollow rigid member engages with the inner ring by having the hollow rigid member slide through the inner ring such that the inner ring slides over the second one or more snapping elements and interacts with the second flange causing the inner ring to rest between the second flange and the second one or more snapping elements. In one embodiment, the first one or more snapping elements include an annular ring. In another embodiment where the first engaging includes the second flange and the second one or more snapping elements, the second engaging element includes the first flange and the first one or more snapping elements.

In some embodiments where the first engaging element includes a second flange and second one or more snapping elements, the hollow rigid member includes a third flange extending outwardly from the hollow rigid member proximate the top end and spaced from the second flange, in which the second flange is positioned between the first and third flanges. In operation, the third flange may be used to provide a seal between a removable lid and the hollow rigid member.

In some embodiments where the second engaging element includes a first flange and first one or more snapping elements, the hollow rigid member has an interior annular wall and one or more inwardly extending elements proximate the base end and further includes an annular insert inside the base end and against the interior annual wall. In one embodiment, the annular insert, in which the extendible spout is connected thereto and extending therefrom, includes the first flange and a recessed channel distal the first flange for engaging the one or more inwardly extending elements and fixing the annular insert to the base end. In another embodiment, the annular insert, in which the extendible spout is connected thereto and extending therefrom, includes the first flange and a recessed channel proximate the first flange for engaging the one or more inwardly extending elements and fixing the annular insert to the base end. This interaction between the one or more inwardly extending elements and the recessed channel provide a secure, and in some instances permanent, connection of the annular insert of the hollow rigid member to the base end thereof.

In other embodiments, the second engaging element includes first one or more threads proximate the base end for engaging the inner ring of the handling portion and fixing the hollow rigid member to the handling portion when the hollow rigid member is in the extended position. That is, in operation, the base end is engaged with the inner ring by having the hollow rigid member slide through the inner ring such that the inner ring meets the first one or more threads and is subsequently maneuvered, for example, twisted, to interlock with the first one or more threads. In one embodiment, the second engaging element further includes a first flange extending outwardly from the hollow rigid member proximate the base end.

In some embodiments where the second engaging element includes first one or more threads, the hollow rigid member is selectively positionable from the recessed position to the extended position by pulling the top end in a direction away from the hollow rigid member and threadably engaging the inner ring to the base end of the hollow rigid member. In a further embodiment, the hollow rigid member may also be selectively positionable from the extended position to the recessed position by threadably disengaging the inner ring of the handling portion from the base end and applying force to the top end in a direction towards the hollow rigid member.

In some embodiments where the second engaging element includes first one or more threads, the hollow rigid member has an interior annular wall and a recessed channel within the interior annular wall proximate the base end and further includes an annular insert inside the base end and against the interior annual wall. In one embodiment, the annular insert, in which the extendible spout is connected thereto and extending therefrom, includes the first flange and an outwardly extending element proximate the first flange for engaging the recessed channel and fixing the annular insert to the base end. This interaction between the recessed channel and the outwardly extending element beneficially provides a secure, and in some instances permanent, connection of the annular insert of the hollow rigid member to the base end thereof.

In some embodiments, the first engaging element includes second one or more threads proximate the top end for engaging the inner ring of the handling portion and fixing the hollow rigid member to the handling portion when the hollow rigid member is in the recessed position. That is, in operation, the top end is engaged with the inner ring by having the hollow rigid member slide through the inner ring such that the inner ring meets the second one or more threads and is subsequently maneuvered, for example, twisted, to interlock with the second one or more threads. In one embodiment, the first engagement element further includes a second flange extending outwardly from the hollow rigid member proximate the top end. In another embodiment where the first engaging element includes the second one or more threads, the second engaging element includes the first one or more threads In some embodiments where the first engaging element includes second one or more threads, the hollow rigid member is selectively positionable from the recessed position to the extended position by threadably disengaging the inner ring of the handling portion from the top end, pulling the top end in a direction away from the handling portion, and threadably engaging the inner ring to the base end of the hollow rigid member. In a further embodiment, the hollow rigid member may be also selectively positionable from the extended position to the recessed position by threadably disengaging the inner ring of the handling portion from the base end, applying force to the top end in a direction towards the handling portion, and engaging the inner ring of to the top end of the hollow rigid member.

In some embodiments, the inner ring has an inner surface and an outer surface, in which the inner surface includes third one or more threads that correspond to the first and the second one or more threads, such that the third one or more threads of the inner ring threadably engages and interlocks with the first one or more threads when the hollow rigid member is in the extended position and with the second one or more threads when the hollow rigid member is in the recessed position.

In embodiments, the detachable dispensing systems described herein also include an extendible spout that is at least partially disposed in and connected to the hollow rigid member. The extendible spout includes a proximal end and a proximal opening, a distal end and a distal opening, and a discharge passage. The proximal end is connected to the hollow rigid member, the distal end is configured to extend from and retract at least partially into the hollow rigid member, and the discharge passage extends from the proximal opening to the distal opening. The extendible spout is configured to dispense the pourable material from the container through the distal opening when the handling portion is engaged about the dispensing opening of the container, thereby enabling the pourable material to be dispensed in areas or receiving vessels otherwise not possible due to, for example, the size or shape of the receiving vessel or the container itself. The extendible spout also is configured to provide directional transfer and enables the pourable materials to be transferred from the container to areas or receiving vessels without being exposed to the environment.

In some embodiments, the extendible spout is made of a thermoplastic material, a paper material, or the like, or combinations thereof. Non-limiting examples of suitable thermoplastic materials include polypropylene, polyethylene, and the like. In one embodiment, the paper material is coated with either a plastic layer or a wax layer.

In some embodiments, the extendible spout is formed by extrusion molding.

In embodiments, the proximal end of the extendible spout is connected to the hollow rigid member. This connection secures the extendible spout so as to prevent the extendible spout from disengaging the hollow rigid member, particularly during operation.

In some embodiments, the proximal end of the extendible spout is directly connected to hollow rigid member. That is, the proximal end is affixed to the interior annular wall or the annular insert of the hollow rigid member proximate the base end. In one embodiment, the proximal end is connected to the hollow rigid member using a bonding method. Non-limiting examples of suitable bonding methods include adhesive gluing, sonic welding, and the like.

In other embodiments, the proximal end of the extendible spout is indirectly connected to the hollow rigid member. That is, the proximal end is affixed to another component or components and that component or components is/are at least partially affixed to the inner surface of the hollow rigid member proximate the base end.

In some embodiments the extendible spout includes a corrugated portion. In another embodiment, the extendible portion is flexible. In yet another embodiment, the extendible spout includes a corrugated portion and is flexible.

In some embodiments, the corrugated portion and the extendible spout are made of the same material. In other embodiments, the corrugated portion and the extendible spout are made of different materials. Non-limiting examples of suitable materials in which the corrugated portion may be made of include thermoplastic materials, paper materials, and the like. In one embodiment, the paper material is coated with either a plastic or a wax layer.

In some embodiments, the corrugated portion may be formed in the same manner as the extendible spout. In another embodiment, the corrugated portion may be formed in a different manner as the extendible spout. In one embodiment, the corrugated portion is formed by extrusion molding.

In some embodiments, the extendible spout is selectively positionable in a retracted configuration in which the extendible spout is retracted and the distal end is at least partially disposed within the hollow rigid member, and, alternatively, an extended configuration in which the extendible spout is extended and the distal end extends out of the hollow rigid member. That is, the length of the extendible spout can be varied prior to, during, or after use, and therefore not fixed to one specific length. This feature beneficially provides the detachable dispensing systems with the ability to dispense material from a container into various destinations without having to disconnect the system from the container.

In one embodiment, a user may insert a finger or tool into the distal end of the extendible spout to adjust the extendible spout from one extended length to a second extended length, when desired.

As used herein, "selectively positionable" when used to describe the extendible spout means capable of being arranged, e.g. by a user, from a retracted configuration to an extended configuration and vice versa at desired times.

In operation, the extendible spout may be selectively positioned in a fully extended configuration or a partially extended configuration. In one embodiment, the extendible spout, when in a fully extended configuration, has a length of about 3 inches to about 40 inches. In one embodiment, the extendible spout, when in a fully extended configuration, has a length of about 5 inches or less. In another embodiment, the extendible spout, when in a fully extended configuration, has a length of about 40 inches or less. In yet another embodiment, the extendible spout, when in a fully extended configuration, has a length of about 8 inches to about 21 inches. In another embodiment, the extendible spout, when in a fully extended configuration, has a length of about 8 inches to about 30 inches. In other embodiments, the extendible spout, when in a fully extended configuration, has a length of about 8 inches to about 40 inches.

In operation, the extendible spout may be selectively positioned in a fully retracted configuration or a partially retracted configuration. In some embodiments, the extendible spout, when in a fully retracted configuration, has a length that is about equal to or less than the length of the hollow rigid member.

In some embodiments, the extendible spout is configured to expand, in relationship to the length of the hollow rigid member, at a ratio of 3:1. For example, for every inch of hollow rigid member, the extendible spout can fully expand to 3 inches.

In some embodiments, the inner surface of the distal end of the extendible spout comprises grooves or dimples to aid a user in extending the extendible spout from the hollow rigid member into an extended configuration. In another embodiment, a lip or ridge is located on at least one of an inner surface or an outer surface of the distal end of the extendible spout. The lip or ridge may be similarly configured to aid a user in extending the extendible spout from the hollow rigid member.

In some embodiments, the detachable dispensing system includes a removable safety seal covering the distal opening of the extendible spout. In one embodiment, the removable safety seal is connected to the distal opening of the extendible spout. In another embodiment, the removable safety seal is connected to the inner surface of the distal end of the extendible spout. In yet another embodiment, the removable safety seal may be connected to the outer surface of the distal end. In certain embodiments, the removable safety seal is heat sealed to either the distal opening or the inner surface of the distal end for attachment.

In some embodiments, the detachable dispensing system includes a removable safety seal covering the proximal end of the extendible spout. In one embodiment, the removable safety seal is connected to the proximal opening of the extendible spout. In another embodiment, the removable safety seal is connected to the inner surface of the proximal end of the extendible spout. In yet another embodiment, the removable safety seal may be connected to the outer surface of the proximal end. In certain embodiments, the removable safety seal is heat sealed to either the proximal opening or the inner surface of the proximal end for attachment.

In another embodiment, the removable safety seal is connected to the hollow rigid member proximate either the top end, for example, when the extendible spout is substantially retracted, if not fully, into the hollow rigid member, or the base end.

In some embodiments, the detachable dispensing system includes more than one removable safety seal. For example, in one embodiment, the distal opening of the extendible spout is covered with a first removable safety seal and the inner surface of the extendible spout is covered with a second removable safety seal.

In some embodiments, the removable safety seal includes a metal foil that is coated with a plastic layer, in which the plastic layer faces the direction of the discharge passage. Non-limiting examples of suitable metal foils include aluminum, platinum, and the like.

In some embodiments, the removable safety seal may be punctured for removal. In another embodiment, the removable safety seal may include a pull tab to enable a user to remove the removable safety seal from either the extendible spout or the hollow rigid member with a pealing motion.

In some embodiments, the detachable dispensing system includes a removable lid that covers the top end of the hollow rigid member, when the hollow rigid member is in the recessed position. In one embodiment, the removable lid is hingedly connected to the hollow rigid member. In another embodiment, the removable lid includes a tab that extends from the lid to enable a user to remove the lid and access the extendible spout. In yet another embodiment, the removable lid is releasably connected to the handling portion with a fastening element (e.g., a clamp or a snap) or a friction fit. In another embodiment, the removable lid includes inner one or more threads configured to engage the outer one or more threads that are disposed on the outer periphery of the handling portion.

In an embodiment, the removable lid includes a sealing flange that engages with the top end of the hollow rigid member to form a seal between the lid, when in the closed position, and the hollow rigid member. In one embodiment, the sealing flange engages with the top end of the hollow rigid member by mating against the outer wall of the hollow rigid member when the lid is in the closed position. In another embodiment, the sealing flange engages with the top end of the hollow rigid member by converging atop the top end of hollow rigid member, in which upon converging at least a portion of the sealing flange bends or curves in an outwardly direction.

Figure 8:
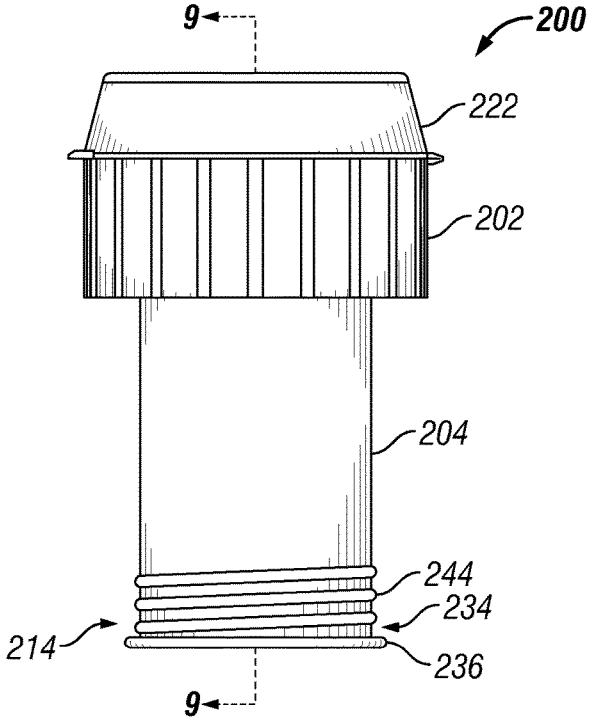
FIG. 8 is a side elevation view of a detachable dispensing system with a hollow rigid member in a recessed position, an extendible spout in a retracted configuration, and a lid in a closed position in accordance with other embodiments of the present disclosure.

In embodiments, the removable lid is in a closed position when the lid covers the top end of the hollow rigid member, for example as illustrated in FIGS. 1 and 8. In embodiments, the removable lid is in an open position when the lid is either completely or at least partially removed from the detachable dispensing system, thereby uncovering and exposing at least a portion of the hollow rigid member, for example, as illustrated in FIGS. 3, 5, 10, and 12.

In some embodiments, the pourable material is a fluid. In embodiments, the fluid is a liquid or the combination of a liquid and a gas. Non-limiting examples of suitable fluids include motor oil, and the like. In other embodiments, the pourable material is a flowable solid. Non-limiting examples of suitable flowable solids includes sand, pebbles, and the like. In yet other embodiments, the pourable material is a combination of a fluid and flowable solid.

Referring now to the drawings, in which like numerals refer to like elements throughout the several views, FIG. 1-7 and FIG. 8-14 illustrate two different exemplary detachable dispensing systems.

FIGS. 1-7 depict an exemplary embodiment of a detachable dispensing system 100 in various configurations. The system 100 generally includes a handling portion 102, a hollow rigid member 104, and an extendible spout 106. The handling portion 102 includes an outer ring 108 and an inner ring 110 that is spaced inwardly from the outer ring 108. The hollow rigid member 104 includes a top end 112, a base end 114, an interior annular wall 116, an annular insert 118 inside the base end 114 and against the interior annular wall 116, and one or more inwardly extending elements 117 proximate the base end 114. The annular insert 118 includes a first flange 136 and a recessed channel 119, wherein the recessed channel 119 engages the one or more inwardly extending elements 117 to fix the annular insert 118 to the base end 114. In this particular embodiment, the recessed channel 119 is distal to the first flange 136. The hollow rigid member 104, in some embodiments, may also include a third flange 120 extending outwardly from the top end 112. The extendible spout 106 is at least partially disposed in the hollow rigid member 104 and securely connected to annular insert 118 of the hollow rigid member 104.

Figure 2:
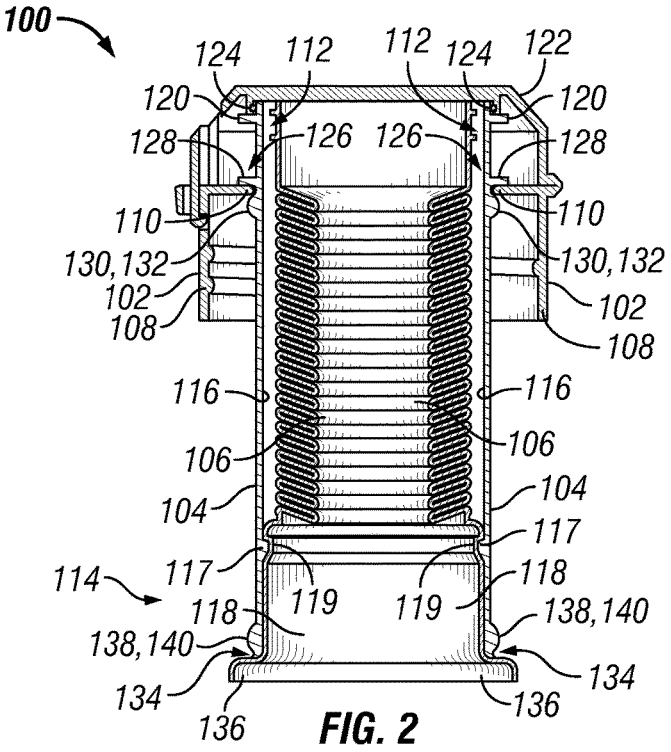
FIG. 2 is a cross-sectional view of the detachable dispensing system in FIG. 1 taken at 2-2.
Figure 3:
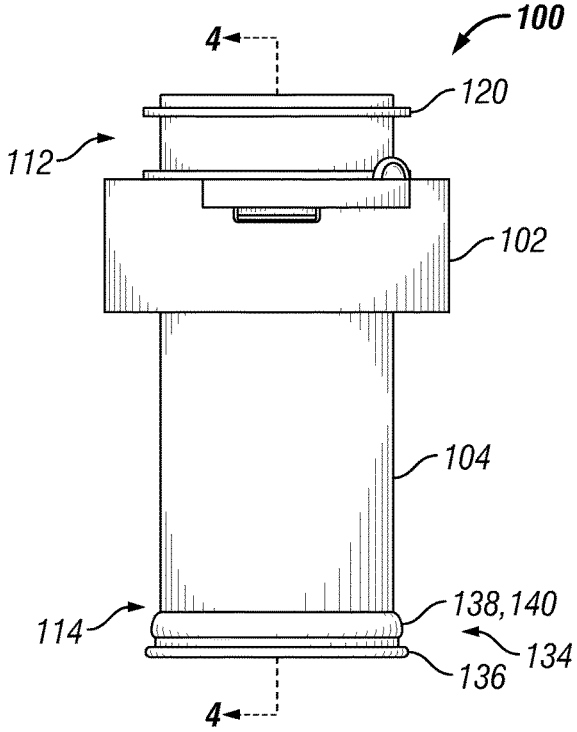
FIG. 3 is a side elevation view of the detachable dispensing system in FIG. 1 with the hollow rigid member in the recessed position and the lid in an open position in accordance with an embodiment of the present disclosure.
Figure 4:
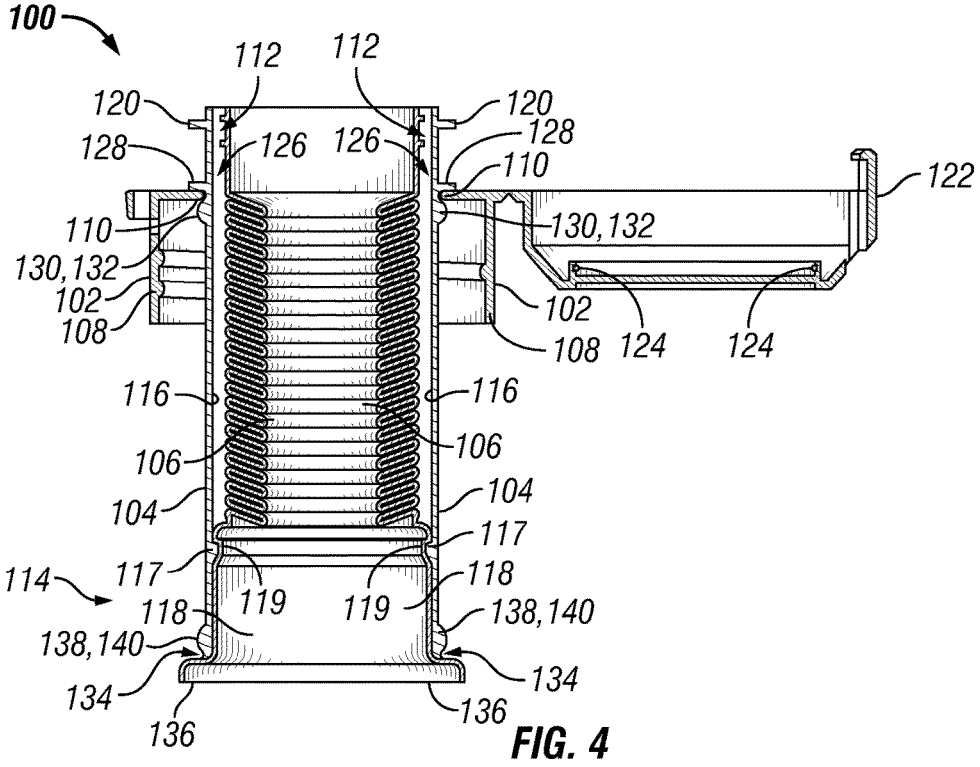
FIG. 4 is a cross-sectional view of the detachable dispensing system in FIG. 3 taken at 4-4.

In FIGS. 1-2 the detachable dispensing system 100 is depicted with a removable lid 122 in a closed position. The removable lid 122 is hindgedly attached to the handling portion 102 and covers the top end 112 of the hollow rigid member 104. The removable lid 122 also includes a sealing flange 124. In FIGS. 1-2, the sealing flange 124 engages with the third flange 120 to provide a seal fit between the removable lid 122, when in the closed position, and the top end 112 of the hollow rigid member 104.

In FIGS. 1-4, the detachable dispensing system 100 is depicted in a recessed position. That is, the top end 112 of the hollow rigid member 104 is proximate the handling portion 102 and the base end 114 extends away from the handling portion 102. The top end 112 includes a first engaging element 126 that extends outwardly from the top end 112 and engages at least a portion of the inner ring 110, such that the hollow rigid member 104 is fixed to the handling portion 102 so to prevent the hollow rigid member 104 from disengaging and separating from the handling portion 102, e.g. moving through the handing portion into the container when engaged about the dispensing opening.

The first engaging element 126 includes a second flange 128 and corresponding second one or more snapping elements 130 both of which extend outwardly from the hollow rigid member 104 proximate the top end 112. The second one or more snapping elements 130 include an annular ring 132. The second flange 128 extends further outwardly from the hollow rigid member 104 than the second or more snapping elements 130 such that the top end 112 of the hollow rigid member 104 engages with the inner ring 110 of the handling portion 102 between the second flange 128 and the second one or more snapping elements 130. This type of engagement advantageously retains the hollow rigid member 104 in a recessed positioned with a snap interference fit for a desired period of time.

Figure 5:
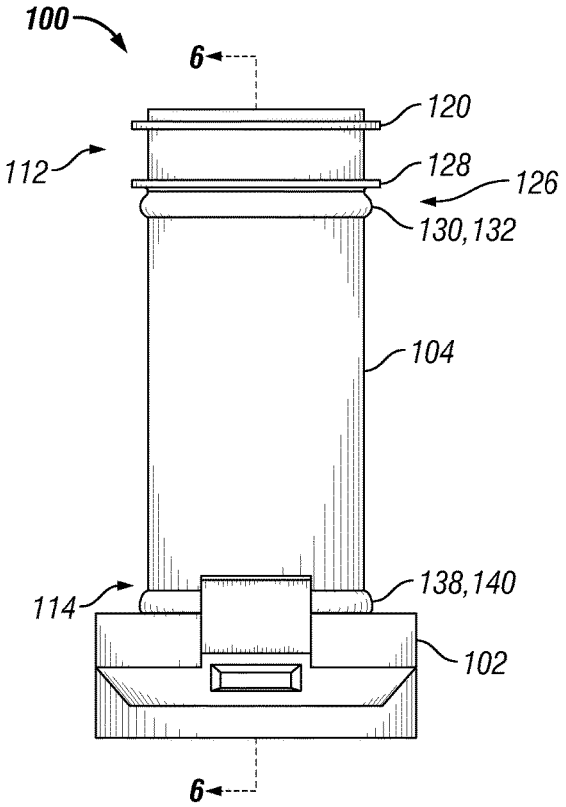
FIG. 5 is a side elevation view of the detachable dispensing system in FIG. 1 with the hollow rigid member in an extended position in accordance with an embodiment of the present disclosure.
Figure 6:
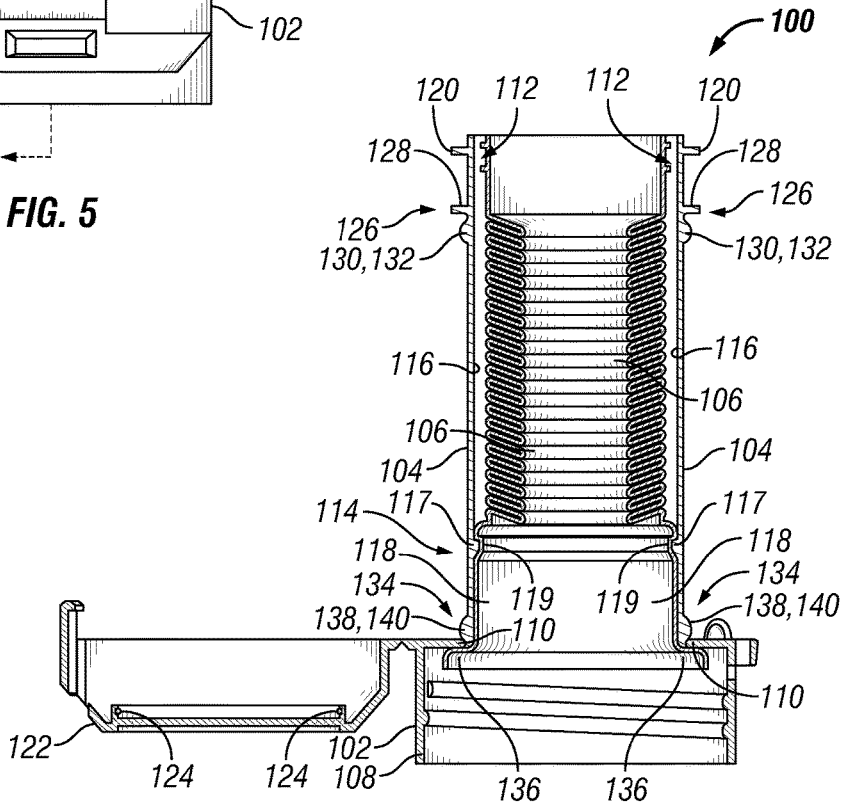
FIG. 6 is a cross-sectional view of the detachable dispensing system in FIG. 5 taken at 6-6.
Figure 7:
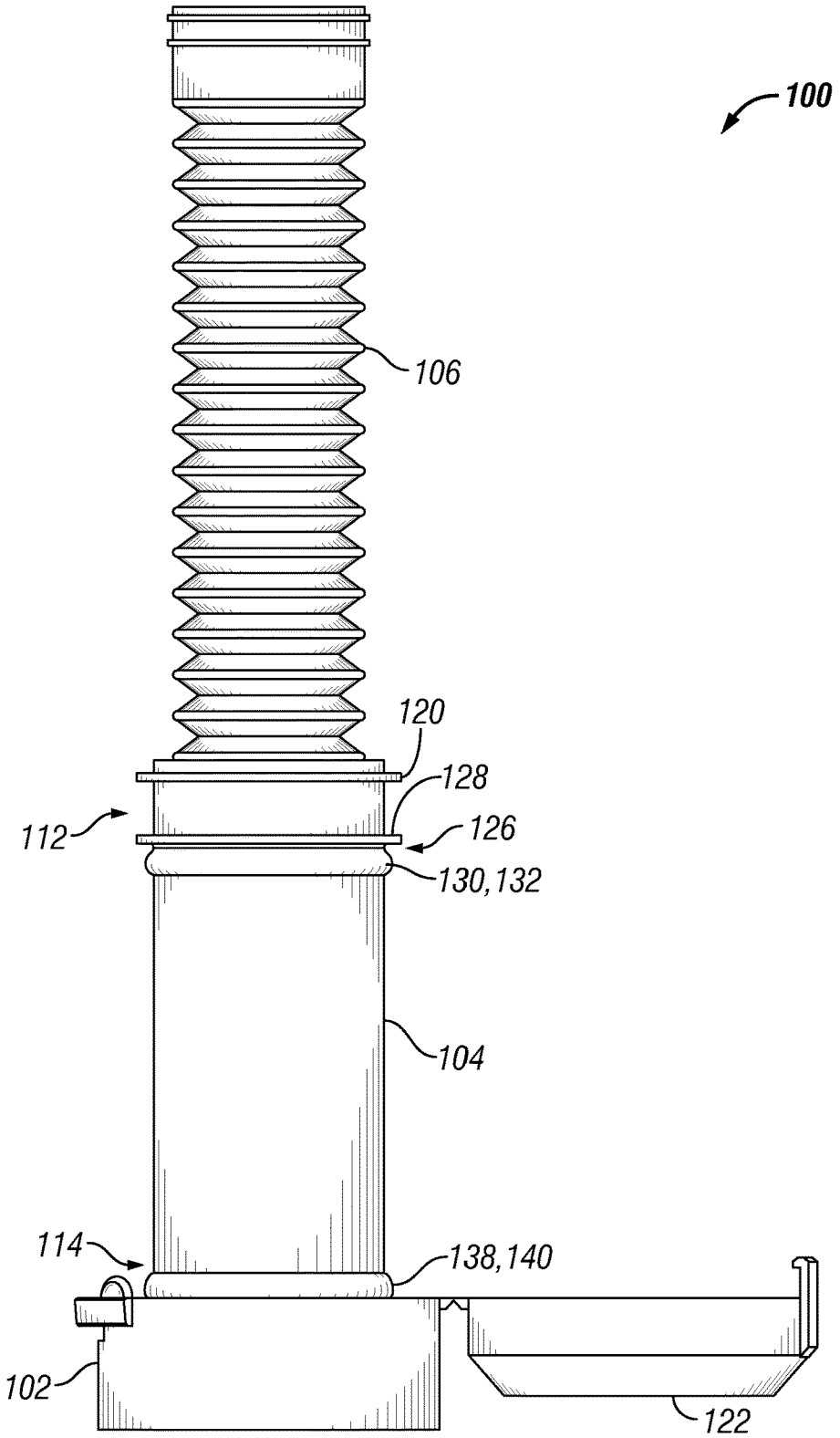
FIG. 7 is a side elevation view of the detachable system in FIG. 5 with the extendible spout in an extended configuration.

In FIGS. 3-7, the detachable dispensing system 100 is depicted with the removable lid 116 in an open position, thereby exposing the top end 112 of the hollow rigid member 104. Once the removable lid 116 is in the open position, the hollow rigid member 104 may be positioned from the recessed position, illustrated in FIGS. 3-4, to an extended position, for example, as illustrated in FIGS. 5-7. In this embodiment, the hollow rigid member 104 may be selectively positioned from the recessed position to the extended position by applying a pulling force to the top end 112 of the hollow rigid member 104 away from the handling portion 102, thereby disengaging the top end 112 from the first engaging element 118 and sliding the hollow rigid member 104 into engagement with the base end 114.

In FIGS. 5-7, the detachable dispensing system 100 is depicted in an extended position. That is, the base end 114 of the hollow rigid member 104 is proximate to the handling portion 102. The base end 114 includes a second engaging element 134 that engages at least a portion of the inner ring 110, such that the hollow rigid member 104 is fixed to the handling portion 102.

The second engaging element 134 includes the first flange 136, which is part of the annular insert 118 of the hollow rigid member 104, and corresponding first one or more snapping elements 138 both of which extend outwardly from the hollow rigid member 104 proximate the base end 114. The first one or more snapping elements 138 include an annular ring 140. The first one or more snapping elements 138 are also spaced inwardly from the first flange 136 for engaging the base end 114 of the hollow rigid member 104 with the inner ring 110 of the handling portion 102 between the first flange 136 and the first one or more snapping elements 138. This type of engagement advantageously retains the hollow rigid member 104 in an extended position with a snap interference fit for a desired period of time.

Figure 17:
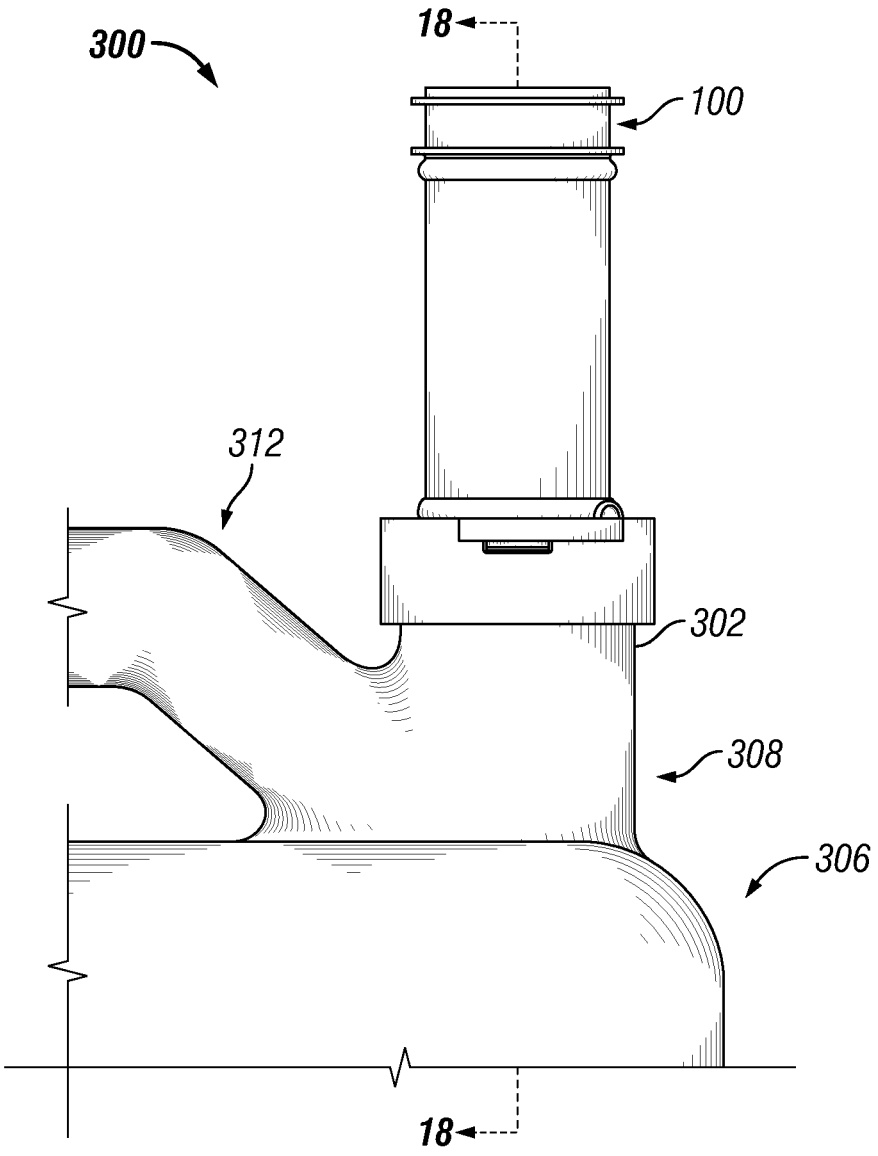
FIG. 17 is a partial side elevation view of the material container in FIG. 15, in which the detachable dispensing system in FIG. 5 is engaged with the container in accordance with an embodiment of the present disclosure.
Figure 18:
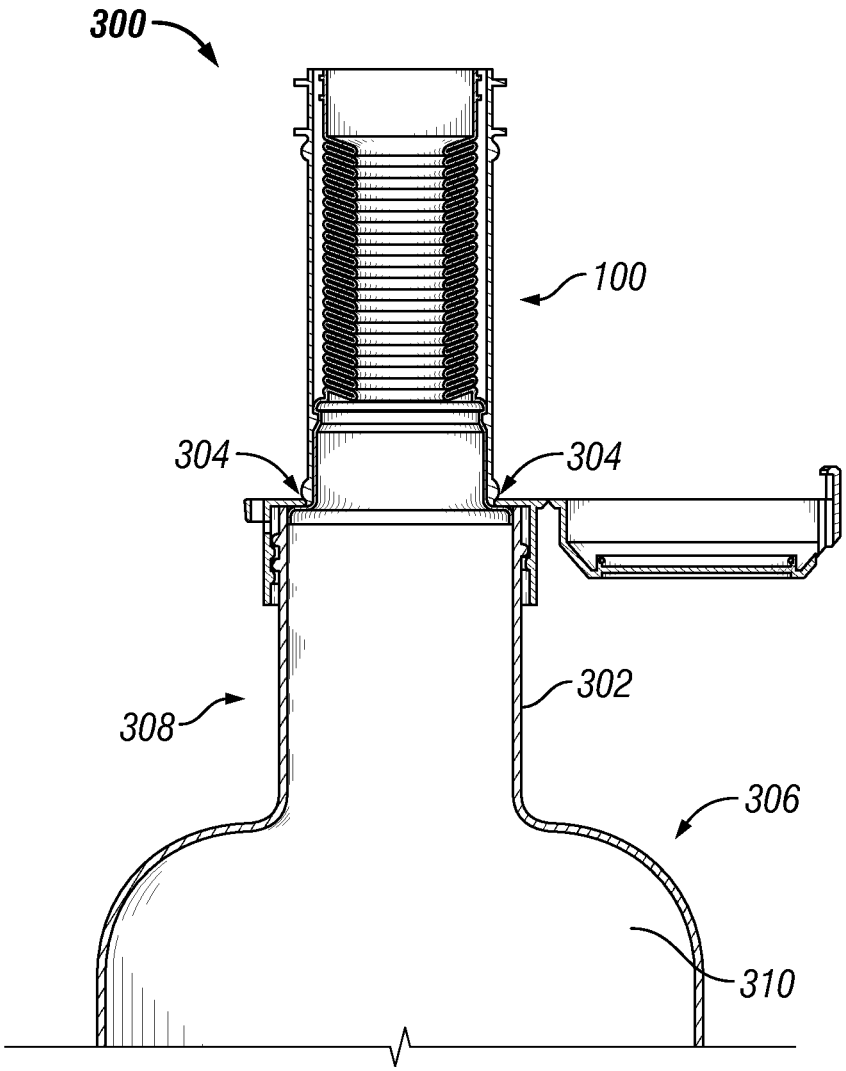
FIG. 18 is a cross-sectional view of the material container in FIG. 17 at 18-18.
Figure 19:
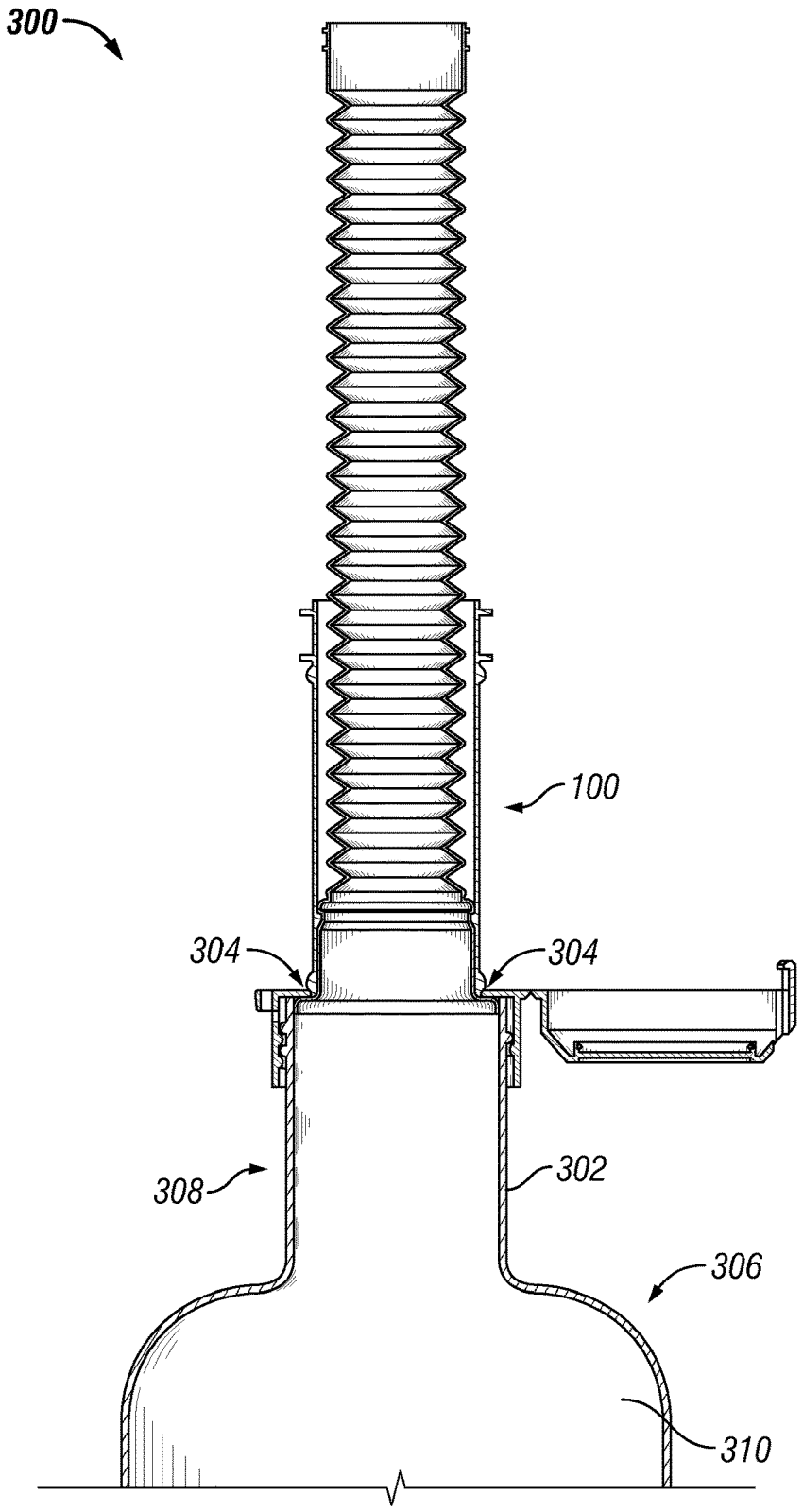
FIG. 19 is a cross-sectional view of the material container in FIG. 17, in which the extendible spout is in an extended configuration.
Figure 20:
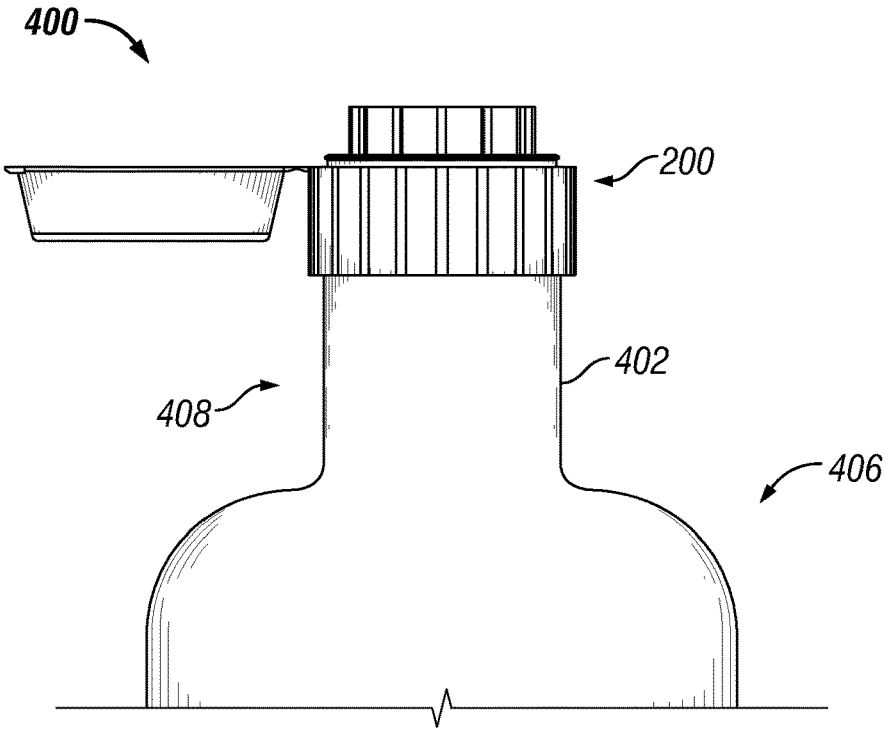
FIG. 20 is a partial side elevation view of a material container, in which the detachable dispensing system in FIG. 10 is engaged with the container in accordance with an embodiment of the present disclosure.

In the extended position, the hollow rigid member 104 is configured to be substantially flush with at the inner ring 110 of the handling portion 102, as illustrated in FIGS. 17-19. That is, the extended position of the hollow rigid member enables the hollow rigid member to be substantially removed from inside the container, that is at least above the fill line for the pourable material, thereby allowing substantially all, if not all, of the contents of the container to be dispensed therefrom. The ability to substantially remove the hollow rigid member from inside the container while the handling portion stays engaged about the dispensing opening of the container beneficially avoids undesirable trapping of the pourable material of the container during dispensing thereof.

Referring now to FIG. 7, the extendible spout 106 is illustrated as being fully extended from the hollow rigid member 104. The extendible spout 106, when extended, partially or fully, from the hollow rigid member 104, may then be additionally manipulated in a manner, e.g., bent, such that the extendible spout 106 provides access, and therefore the ability to dispense contents, to receiving areas that would have otherwise been inaccessible due to, for example, location, container size, and/or container contents.

FIGS. 8-14 depict an exemplary embodiment of a detachable dispensing system 200 in various configurations. The system 200 generally includes a handling portion 202, a hollow rigid member 204, and an extendible spout 206. The handling portion 202 includes an outer ring 208 and an inner ring 210 spaced inwardly from the outer ring 208. The hollow rigid member 204 includes a top end 212, a base end 214, an interior annular wall 216, a recessed channel 246 within the interior annular wall 216, and an annular insert 218 inside the base end 214 and against the interior annular wall 216. The annular insert 218 includes a first flange 236 and an outwardly extending element 248 proximate the first flange 236 that engages the recessed channel 246 to fix the annular insert 218 to the base end 214. The hollow rigid member 204, in some embodiments, may include a third flange 220 extending outwardly from the top end 212. The extendible spout 206 is at least partially disposed in the hollow rigid member 204 and securely connected to the annular insert 218 of the hollow rigid member 204.

Figure 9:
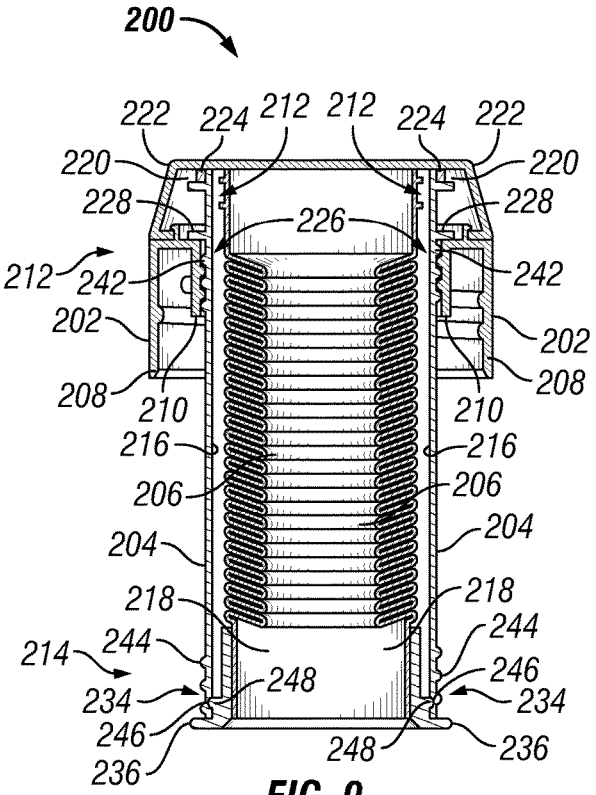
FIG. 9 is a cross-sectional view of the detachable dispensing system in FIG. 8 taken at 9-9.
Figure 10:
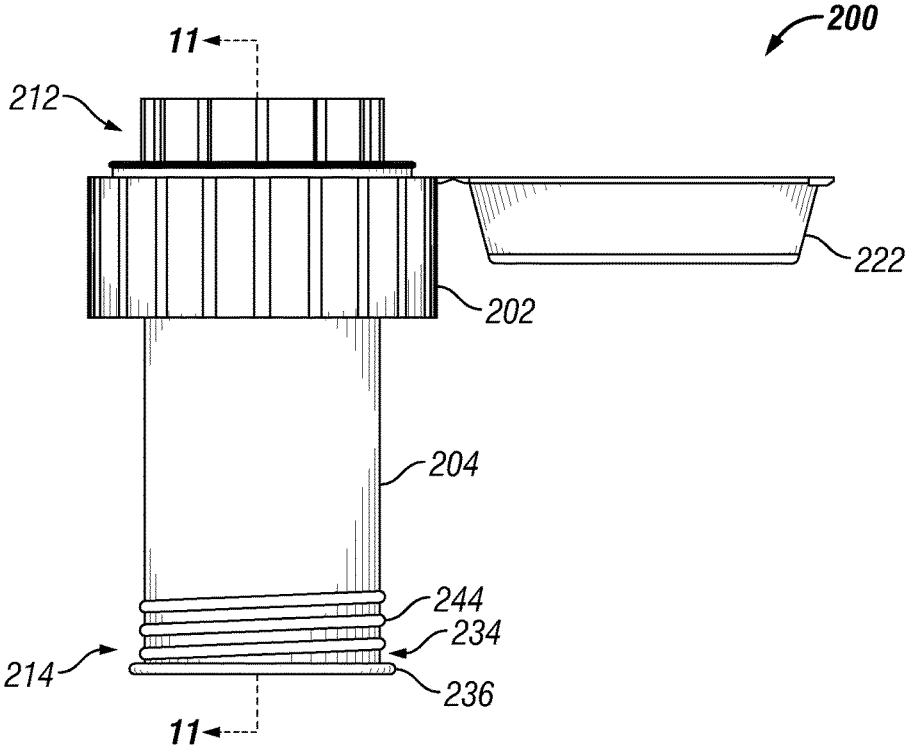
FIG. 10 is a side elevation view of the detachable dispensing system in FIG. 8 with the hollow rigid member in the recessed position and the lid in an open position in accordance with an embodiment of the present disclosure.
Figure 11:
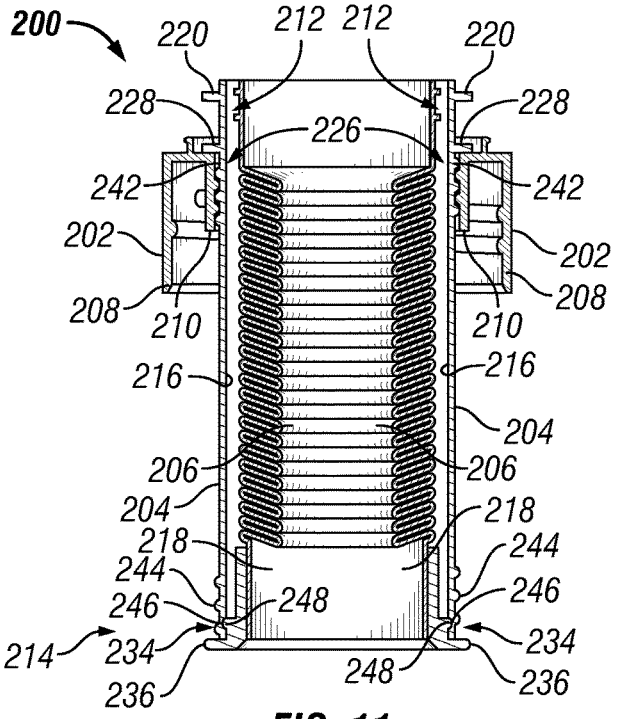
FIG. 11 is a cross-sectional view of the detachable dispensing system in FIG. 10 taken at 11-11.

In FIGS. 8-9 the detachable dispensing system 200 is depicted with a removable lid 222 in a closed position. The removable lid 222 is hindgedly attached to the handling portion 202 and covers the top end 212 of the hollow rigid member 204. The removable lid 222, in some embodiments, includes a sealing flange 224. In FIGS. 8-9, the sealing flange 224 engages with the third flange 220 to provide a seal fit between the removable lid 222, when in the closed position, and the top end 212 of the hollow rigid member 204.

In FIGS. 8-11, the detachable dispensing system 200 is depicted in a recessed position. That is, the top end 212 of the hollow rigid member 204 is proximate the handling portion 202 and the base end 214 extends away from the handling portion 202. The top end 212 includes a first engaging element 226 that extends outwardly from the top end 212 and engages at least a portion of the inner ring 210, such that the hollow rigid member 204 is fixed to the handling portion 202 so to prevent the hollow rigid member 204 from disengaging and separating from the handling portion 202, e.g. moving through the handing portion into the container when engaged about the dispensing opening.

The first engaging element 226 includes second one or more threads 242 proximate the top end 212 for engaging the inner ring 210 of the handling portion 202 and fixing the hollow rigid member 204 to the handling portion 202 when the hollow rigid member 204 is in the in the recessed position. The first engaging element also includes a second flange 228 that extends outwardly from the hollow rigid member 204 proximate the top end 212. This type of engagement advantageously retains the hollow rigid member 204 in the recessed position with a threaded interference fit for a desired period of time.

Figure 12:
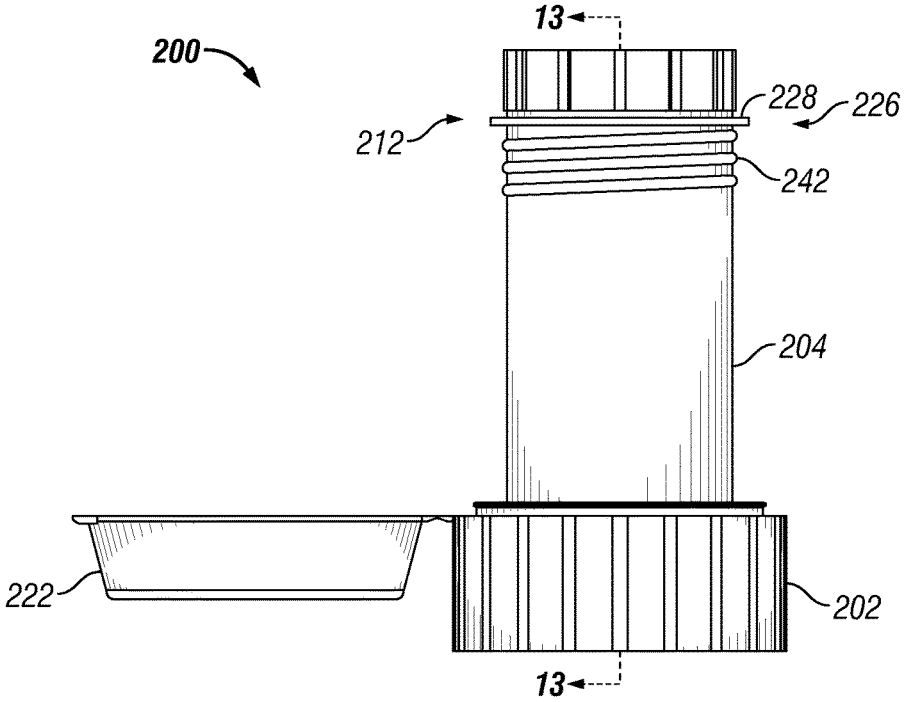
FIG. 12 is a side elevation view of the detachable dispensing system in FIG. 8 with the hollow rigid member in an extended position in accordance with an embodiment of the present disclosure.
Figure 13:
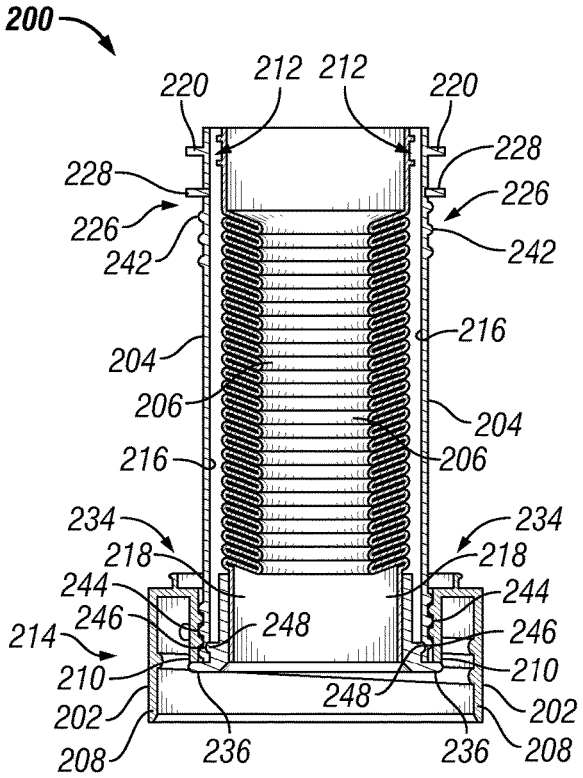
FIG. 13 is a cross-sectional view of the detachable dispensing system in FIG. 12 taken at 13-13.
Figure 14:
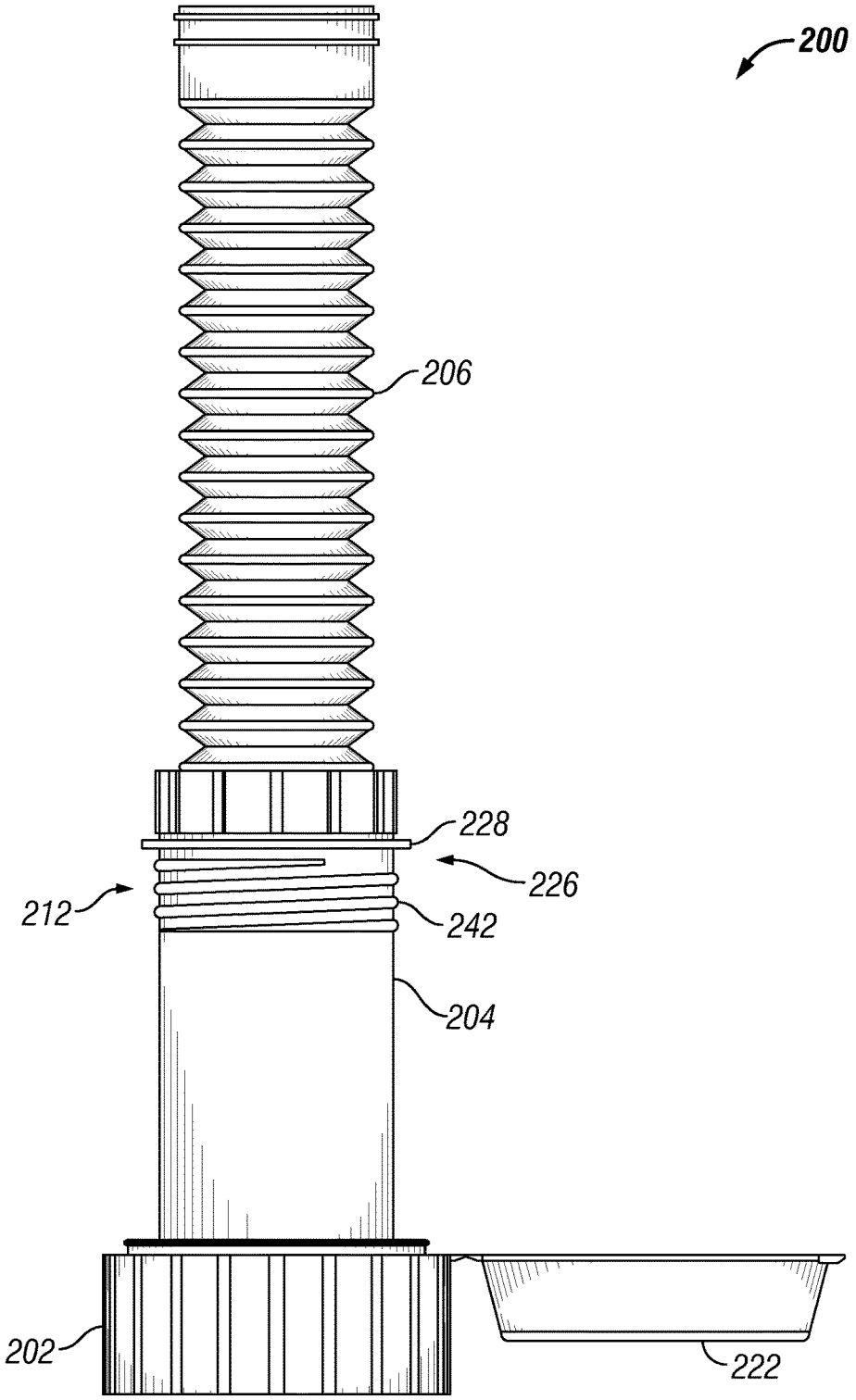
FIG. 14 is a side elevation view of the detachable system in FIG. 12 with the extendible spout in an extended configuration.
Figure 15:
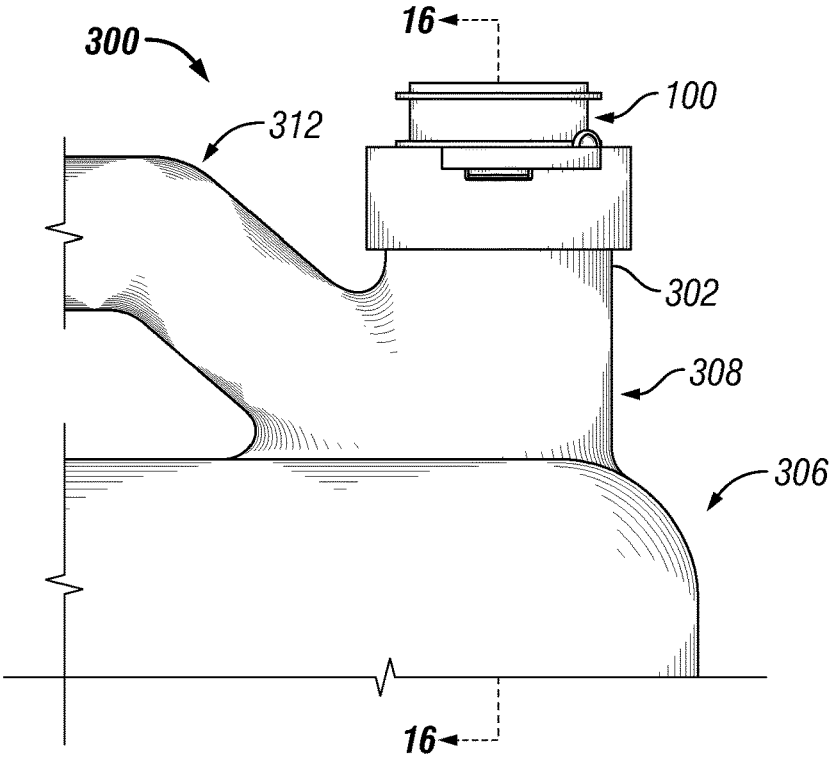
FIG. 15 is a partial side elevation view of a material container, in which the detachable dispensing system in FIG. 3 is engaged with a container in accordance with an embodiment of the present disclosure.

In FIGS. 10-14, the detachable dispensing system 200 is depicted with the removable lid 222 in an open position, thereby exposing the top end 212 of the hollow rigid member 204. Once the removable lid 222 is in the open position, the hollow rigid member 204 may be positioned from the recessed position, illustrated in FIGS. 10-11, to an extended position, for example, as illustrated in FIGS. 12-14. In this embodiment, the hollow rigid member 204 is selectively positioned from the recessed position to the extended position by threadably disengaging the inner ring 210 of the handling portion 202 from the top end 212, pulling the top end 212 away from the handling portion 202, and then subsequently threadably engaging the inner ring 210 to the base end 214 of the hollow rigid member 204.

In FIGS. 12-14, the detachable dispensing system 200 is depicted in an extended position. That is, the base end 214 of the hollow rigid member 204 is proximate to the handling portion 202. The base end 214 includes a second engaging element 234 that engages at least a portion of the inner ring 210, such that the hollow rigid member 204 is fixed to the handling portion 202.

Figure 22:
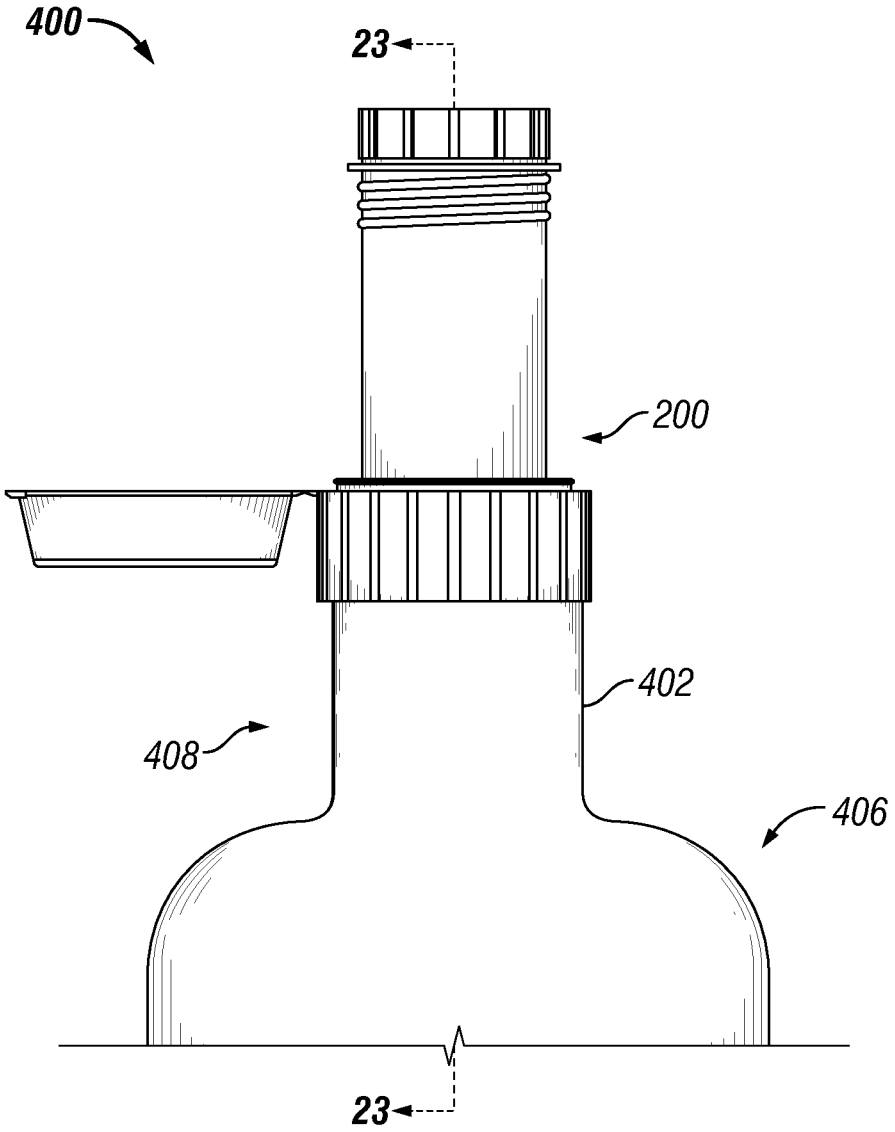
FIG. 22 is a partial side elevation view of the material container in FIG. 20, in which the detachable dispensing system in FIG. 12 is engaged with a container in accordance with an embodiment of the present disclosure.
Figure 23:
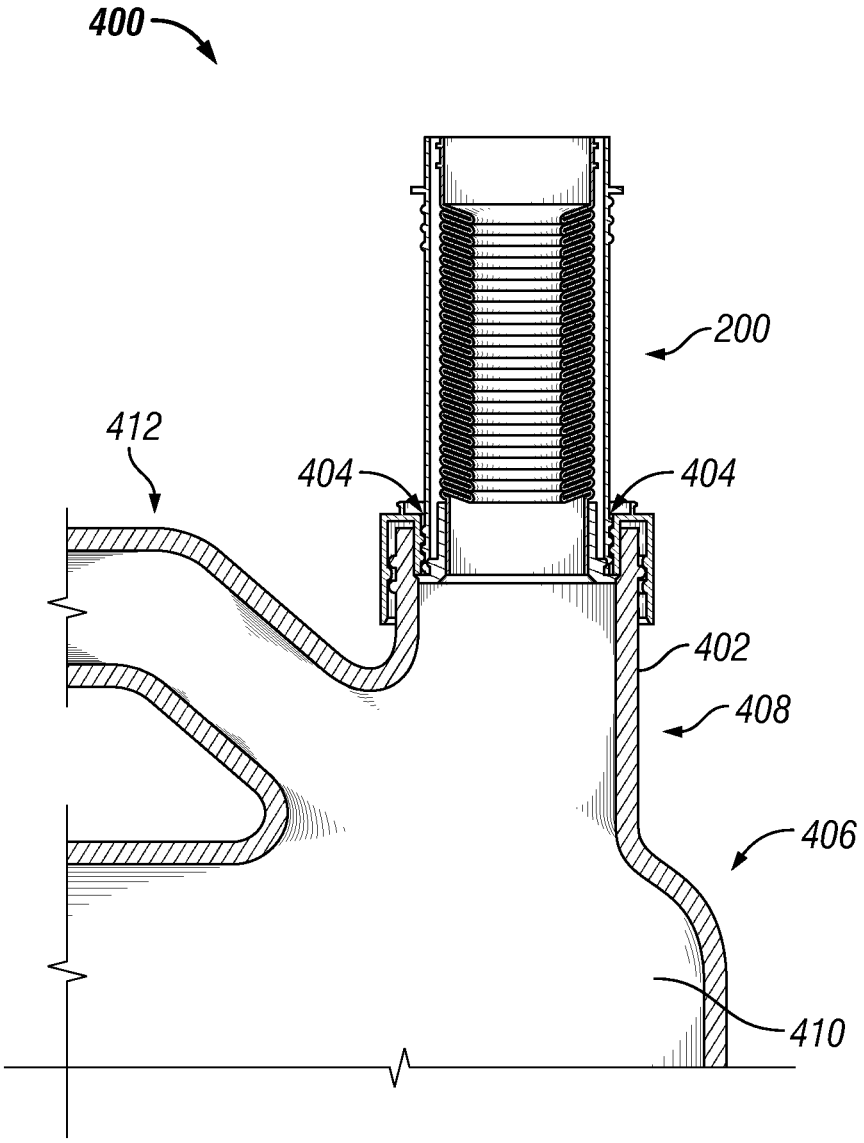
FIG. 23 is a cross-sectional view of the material container in FIG. 22 taken at 23-23.

The second engaging element 234 includes first one or more threads 244 proximate the base end 214 for engaging the inner ring 210 of the handling portion 202 and fixing the hollow rigid member 204 to the handling portion 202 when the hollow rigid member 204 is in the extended position. The second engaging element 234 also includes the first flange 236 that extends outwardly from the hollow rigid member 204 proximate the top end 212. This type of engagement advantageously retains the hollow rigid member 204 in the extended position with a threaded interference fit, for a desired period of time. In the extended position, the hollow rigid member 204 may remain at least partially disposed within the container, as illustrated in FIGS. 22-24.

Figure 24:
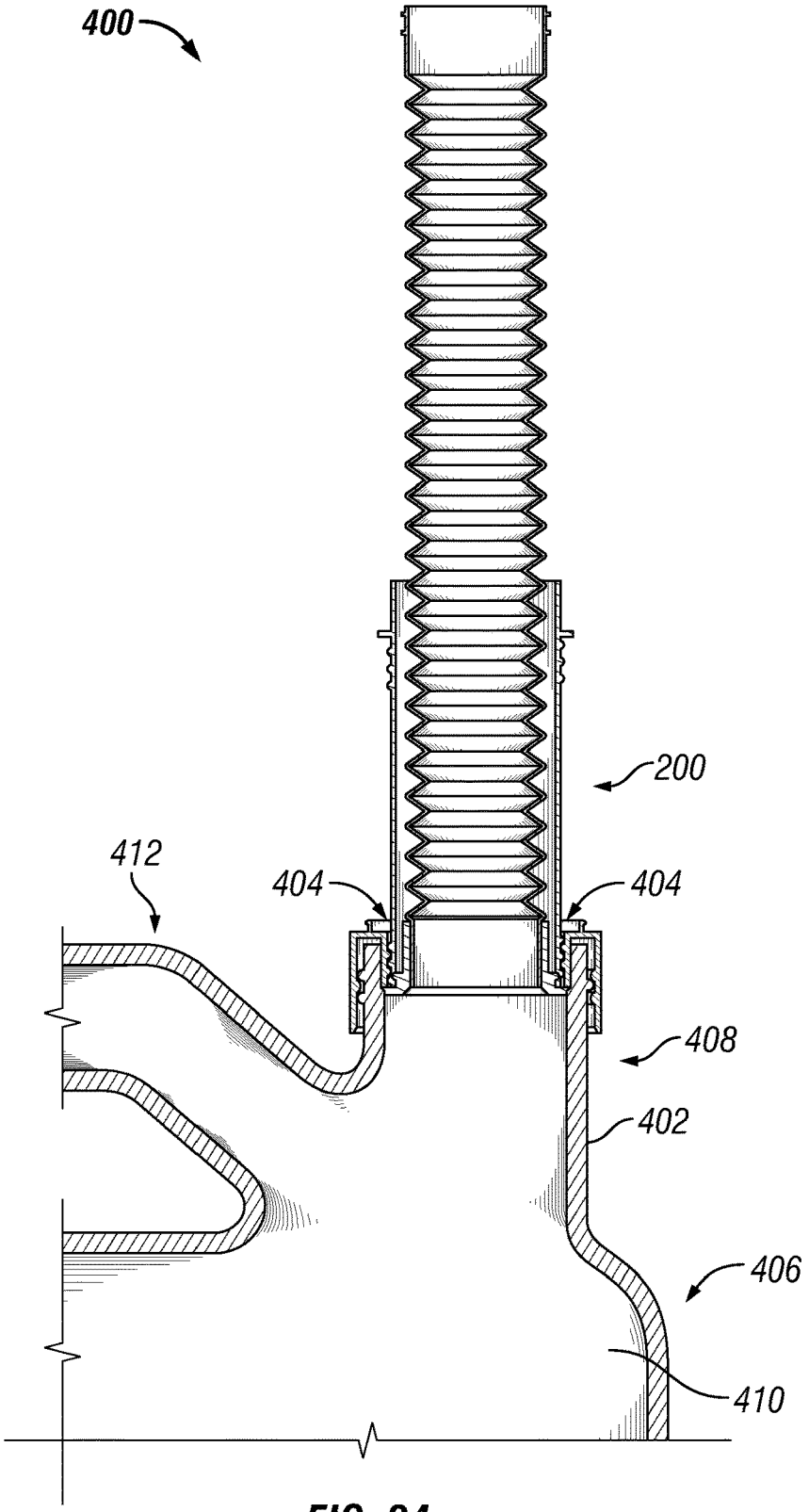
FIG. 24 is a cross-sectional view of the material container in FIG. 22, in which the extendible spout is in an extended configuration.

Referring now to FIG. 24, the extendible spout 206 is illustrated as being fully extended from the hollow rigid member 204. The extendible spout 206, when extended, partially or fully, from the hollow rigid member 204, may then be additionally manipulated in a manner, e.g., bent, such that the extendible spout 206 provides access, and therefore the ability to dispense contents, to receiving areas that would have otherwise been inaccessible due to, for example, location, container size, and/or container contents.

Material Containers

The detachable dispensing systems as described herein may be used in conjunction with a container to form a material container. The material containers described herein generally include a container having a dispensing opening and a detachable dispensing system as described herein and above that is selectively connected to the container about the dispensing opening.

In embodiments, the container generally includes a main body and a neck portion. The main body of the container can take the form of various different structural configurations. For example, the main body of the container may have a cylindrical or a polygonal structural configuration. Non-limiting examples of suitable polygonal structural configurations include a circle, a triangle, a square, and a rectangle. The neck portion of the container can be of any suitable length.

In some embodiments, the detachable dispensing systems are configured such that the systems can be connected and unconnected and vice versa about the dispensing opening as desired. That is, the detachable dispensing systems can be temporality connected to the container. In other embodiments, the detachable dispensing systems are configured such that the system, once connected, is permanently attached to the container.

In some embodiments, the detachable dispensing systems are connected to the containers during the manufacturing of the container, either in-line or off-line. That is, the material containers may be available pre-packaged with the detachable dispensing systems attached to the container. If pre-packaged, this would prevent having to remove the traditional caps from the container prior to connecting the detachable dispensing systems to about the dispensing opening.

In other embodiments, the initial cap of the container must first be removed, and in some embodiments also a seal, thereby exposing the dispensing opening of the container. The detachable dispensing system may then be connected to the container about the dispensing opening.

Referring now to the drawings, in which like numerals refer to like elements throughout the several views, FIGS. 15-19 and FIG. 20-24 illustrate two different exemplary material containers implementing the detachable dispensing system depicted in FIGS. 1-7 and FIGS. 8-14, respectively.

In one embodiment, now referring to FIGS. 15-19, the material container 300 includes a container 302 with a dispensing opening 304. The container 302 has a main body 306 that defines an interior space 310 that is configured to house pourable material therein. The container 302 also has a neck portion 308 in communication with the interior space 310. The material container 300 further includes the detachable dispensing system 100 (as depicted in FIGS. 1-7) that is selectively connected to the container 302 about the dispensing opening 304.

In some embodiments, the neck portion 308 is additionally configured to partially house a portion of the pourable material.

In some embodiments, the container 302 has a gripable or graspable portion 312 to aid in the handling of the container 302 during transportation and/or use.

Figure 16:
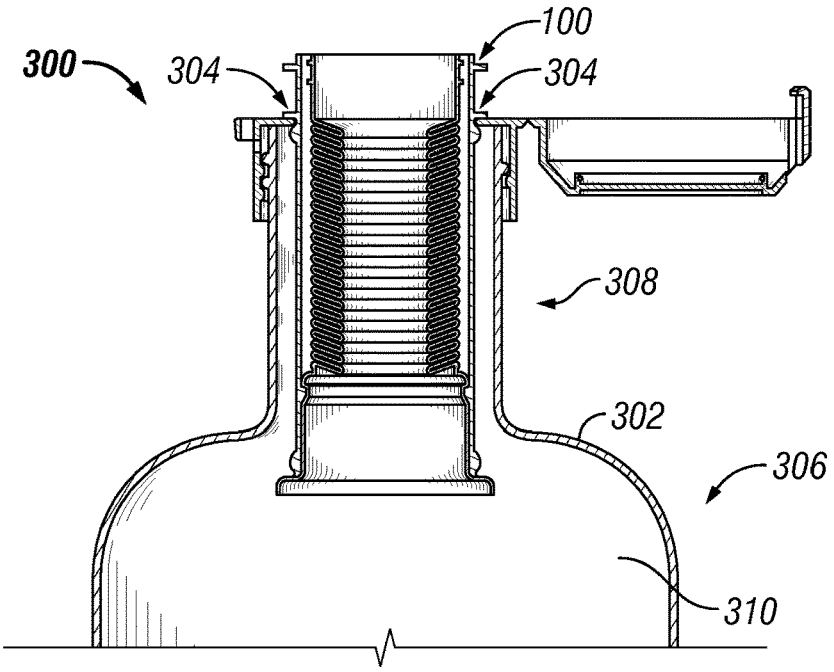
FIG. 16 is a cross-sectional view of the material container in FIG. 15 taken at 16-16.

As illustrated in FIG. 16, the detachable dispensing system 100 when engaged about the dispensing opening 304 and in the recessed position, extends through the neck portion 308 and into at least a portion of the interior space 310 of the main body 306. As illustrated in FIG. 18, the detachable dispensing system 100, when in the extended position, is removed from the interior space 310 of the main body 306 such that the detachable dispensing system 100 is partially positioned within the neck portion 308, wherein the pourable material housed within the main body 306 of the container 302 may then be substantially dispensed therefrom, through the neck portion 308 and then through the detachable dispensing system 100 without being exposed to the environment. The position of the detachable dispensing system in the extended position advantageously prevents the pourable material from being trapped within the neck portion of the container, thereby enabling most, if not all, of the pourable material to be dispensed from the container which is not otherwise plausible with conventional dispensing systems.

In another embodiment, now referring to FIGS. 20-24, the material container 400 includes a container 402 with a dispensing opening 404. The container 402 has a main body 406 that defines an interior space 410 that is configured to house pourable material therein. The container 402 also has a neck portion 408 in communication with the interior space 410. The material container 400 further includes the detachable dispensing system 200 (as depicted in FIGS. 8-14) that is selectively connected to the container 402 about the dispensing opening 404.

In some embodiments, the neck portion 408 is additionally configured to partially house a portion of the pourable material.

In some embodiments, the container 402 has a gripable or graspable portion 412 to aid in the handling of the container 402 during transportation and/or use.

Figure 21:
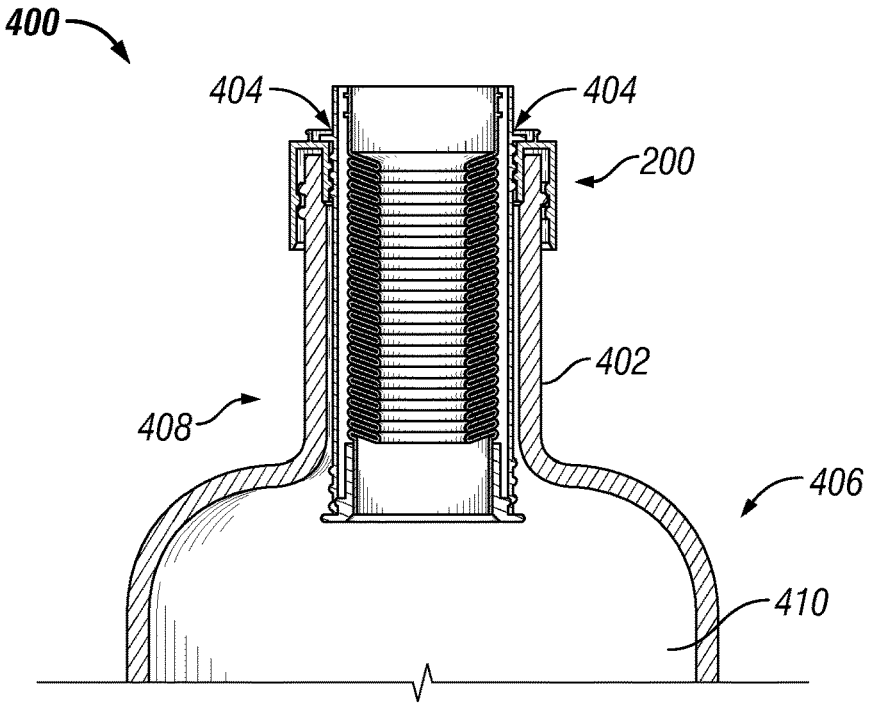
FIG. 21 is a cross-sectional view of the material container in FIG. 20.

As illustrated in FIG. 21, the detachable dispensing system 200 when engaged about the dispensing opening 404 and in the recessed position, extends through the neck portion 408 and into at least a portion of the interior space 410 of the main body 406. As illustrated in FIG. 23, the detachable dispensing system 200, when in the extended position, is removed from the interior space 410 of the main body 406 such that the detachable dispensing system 200 is partially positioned within the neck portion 408, wherein the pourable material housed within the main body 406 of the container 402 may then be substantially dispensed therefrom, through the neck portion 408 and then through the detachable dispensing system 200 without being exposed to the environment. The position of the detachable dispensing system in the extended position, as illustrated in FIG. 23, advantageously prevents the pourable material from being trapped within the neck portion of the container, thereby enabling most, if not all, of the pourable material to be dispensed from the container.

In operation, the container may be opened by removing a lid, and in some embodiments and/or removing or puncturing a removable safety seal, initially provided with the container, or by puncturing the body of the container, thereby exposing a dispensing opening of the container. Once the dispensing opening of the container is exposed, the detachable dispensing system may then be connected to the container about the dispensing opening. The hollow rigid member may then be selectively positioned in the extended position and the extendible spout is at least partially extended from the hollow rigid member. The container is then positioned in a manner such that pourable material within the container enters the extendible spout through the proximal opening, passes through the discharge passage, and exits the extendible spout from the distal opening into the receiving vessel or area.

In operation where the material container is prepackaged, the material container may be opened by removing the removable lid, thereby creating access to the hollow rigid member. The hollow rigid member is then selectively positioned in the extended position and the extendible spout is at least partially extended from the hollow rigid member. The pourable material within the container then enters the extendible spout through the proximal opening, passes through the discharge passage, and exits the extendible spout from the distal opening into the receiving vessel.

After dispensing the desired amount of contents from the container, the detachable dispensing system may either remain connected to the container, in which a removable lid may be introduced or reintroduced to seal off the top end of the hollow rigid member, or disconnected from the container, in which case the container may be resealed with the initial lid provided with the container or discarded.

In some embodiments, the container is positioned in a manner such that the pourable material is gravity fed from the container into the extendible spout. In other embodiments, the container is positioned in a manner such that the pourable material is gravity driven through the extendible spout. It should be noted that the pourable material within the container may be driven into, through, and/or out of the extendible spout by suitable means other than or in addition to gravity, e.g. one or more pumps located internally within and/or externally from the container. In other embodiments, the container includes an orifice, which is initially sealed and subsequently unsealed, to backfill the container with air when the pourable materials are dispensed from the container. In one embodiment, the orifice may be repeatedly sealed and unsealed during or between dispensing periods.

For the purposes of describing and defining the present teachings, it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

It should be apparent that the foregoing relates only to certain embodiments of the present disclosure and that numerous changes and modifications may be made herein without departing from the spirit and the scope of the disclosure as defined by the appended claims and equivalents thereof.

I claim:

1. A detachable dispensing system for a container, the system comprising:

a handling portion comprising an outer ring configured to selectively secure and, alternatively, remove the handling portion about a dispensing opening of the container and an inner ring defining a circular aperture within the handling portion;

a hollow member comprising a top end and a base end, the hollow member slideably disposed within the circular aperture and selectively positionable between a recessed position in which the top end is proximate the handling portion and the base end extends away from the handling portion and toward the container and, alternatively, an extended position in which the top end extends away from the handling portion and the container and the base end is substantially flush with either (i) the dispensing opening of the container or (ii) the inner ring of the handling portion, wherein the top end comprises a first engaging element for engaging at least a portion of the inner ring of the handling portion and preventing the top end of the hollow member from moving through the handling portion into the container when the hollow member is in the recessed position, and wherein the base end comprises a second engaging element for engaging at least a portion of the inner ring of the handling portion and fixing the hollow member to the handling portion when the hollow member is in the extended position; and an extendible spout at least partially disposed in the hollow member and connected to the hollow member, the extendible spout comprising, a proximal end and a proximal opening, the proximal end connected to the hollow member, a distal end and a distal opening, the distal end configured to extend from and retract at least partially into the hollow member, and a discharge passage that extends from the proximal opening to the distal opening, wherein the extendible spout is configured to dispense a pourable material from the container through the distal opening when the handling portion is engaged about the dispensing opening of the container.

2. The system of claim 1, wherein the hollow member is substantially rigid.

3. The system of claim 1, wherein the second engaging element comprises first one or more peripheral elements extending outwardly from the hollow member proximate the base end for engaging the inner ring of the handling portion and fixing the hollow member to the handling portion when the hollow member is in the extended position.

4. The system of claim 1, wherein the second engaging element comprises a first flange extending outwardly from the hollow member proximate the base end and first one or more snapping elements extending outwardly from the hollow member proximate the base end and spaced inwardly from the first flange for engaging the base end of the hollow member with the inner ring of the handling portion between the first flange and the first one or more snapping elements and retaining the hollow member in the extended position with a snap interference fit.

5. The system of claim 3, wherein the hollow member is selectively positionable from the recessed position to the extended position by pulling the top end in a direction away from the handling portion and sliding the hollow member into engagement with the first one or more peripheral elements.

6. The system of claim 5, wherein the hollow member is selectively positionable from the extended position to the recessed position by applying force to the top end in a direction towards the handling portion and sliding the hollow member out of engagement with the first one or more peripheral elements.

7. The system of claim 3, wherein the first engaging element comprises second one or more peripheral elements extending outwardly from the hollow member proximate the top end for engaging the inner ring of the handling portion and fixing the hollow member to the handling portion when the hollow member is in the recessed position.

8. The system of claim 4, wherein the first engaging element comprises a second flange extending outwardly from the hollow member proximate the top end and second one or more snapping elements extending outwardly from the hollow member proximate the top end and spaced inwardly from the second flange for engaging the top end of the hollow member with the inner ring of the handling portion between the second flange and the second one or more snapping elements and retaining the hollow member in the recessed position with a snap interference fit.

9. The system of claim 8, wherein the hollow member further comprises a third flange extending outwardly from the hollow member proximate the top end and spaced from the second flange, the second flange positioned between the first and third flanges.

10. The system of claim 7, wherein the hollow member is selectively positionable from the recessed position to the extended position by pulling the top end in a direction away from the handling portion, disengaging the inner ring of the handling portion from the second one or more peripheral elements, and sliding the hollow member into engagement with the first one or more peripheral elements.

11. The system of claim 10, wherein the hollow member is selectively positionable from the extended position to the recessed position by applying force to the top end in a direction towards the handling portion, sliding the hollow member out of engagement with the first one or more peripheral elements, and engaging the inner ring of the handling portion with the second one or more peripheral elements.

12. The system of claim 4, wherein the first one or more snapping elements comprises an annular ring.

13. The system of claim 8, wherein the second one or more snapping elements comprises an annular ring.

14. The system of claim 4, wherein the hollow member has an interior annular wall and one or more inwardly extending elements and further comprises an annular insert inside the base end and against the interior annular wall, the annular insert comprising the first flange and a recessed channel distal the first flange for engaging the one or more inwardly extending elements and fixing the annular insert to the base end, the extendible spout connected to and extending from the annular insert.

15. The system of claim 4, wherein the first engaging element comprises second one or more threads proximate the top end for engaging the inner ring of the handling portion and fixing the hollow member to the handling portion when the hollow member is in the recessed position.

16. The system of claim 15, wherein the first engaging element further comprises a second flange extending outwardly from the hollow member proximate the top end.

17. The system of claim 1, wherein the second engaging element comprises first one or more threads proximate the base end for engaging the inner ring of the handling portion and fixing the hollow member to the handling portion when the hollow member is in the extended position.

18. The system of claim 17, wherein the second engaging element further comprises a first flange extending outwardly from the hollow member proximate the base end.

19. The system of claim 18, wherein the hollow member has an interior annular wall and a recessed channel within the interior annular wall proximate the base end and further comprises an annular insert inside the base end and against the interior annular wall, the annular insert comprising the first flange and an outwardly extending element proximate the first flange for engaging the recessed channel and fixing the annular insert to the base end, the extendible spout connected to and extending from the annular insert of the hollow member.

20. The system of claim 18, wherein the hollow member is selectively positionable from the recessed position to the extended position by pulling the top end in a direction away from the hollow member and threadably engaging the inner ring to the base end of the hollow member.

21. The system of claim 20, wherein the hollow member is selectively positionable from the extended position to the recessed position by threadably disengaging the inner ring of the handling portion from the base end and applying force to the top end in a direction towards the hollow member.

22. The system of claim 18, wherein the first engaging element comprises second one or more threads proximate the top end for engaging the inner ring of the handling portion and fixing the hollow member to the handling portion when the hollow member is in the recessed position.

23. The system of claim 22, wherein the first engaging element further comprises a second flange extending outwardly from the hollow member proximate the top end.

24. The system of claim 22, wherein the hollow member is selectively positionable from the recessed position to the extended position by threadably disengaging the inner ring of the handling portion from the top end, pulling the top end in a direction away from the handling portion, and threadably engaging the inner ring to the base end of the hollow member.

25. The system of claim 24, wherein the hollow member is selectively positionable from the extended position to the recessed position by threadably disengaging the inner ring of the handling portion from the base end, applying force to the top end in a direction towards the handling portion, and threadably engaging the inner ring to the top end of the hollow member.

26. The system of claim 1, wherein the extendible spout comprises a corrugated portion.

27. The system of claim 1, wherein the extendible spout is flexible.

28. The system of claim 1, wherein the extendible spout is selectively positionable in a retracted configuration in which the extendible spout is retracted and the distal end is at least partially disposed within the hollow member, and, alternatively, an extended configuration in which the extendible spout is extended and the distal end extends out of the hollow member.

29. The system of claim 1, wherein the extendible spout, when in a fully extended configuration, has a length of about 3 inches to about 40 inches.

30. The system of claim 1, wherein the extendible spout, when in a fully retracted position, has a length that is about equal to or less than the length of the hollow member.

31. The system of claim 1, further comprising a removable lid that covers the top end of the hollow member.

32. The system of claim 31, wherein the removable lid is hingedly connected to the handling portion.

33. The system of claim 32, wherein the removable lid comprises a sealing flange that engages with the top end of the hollow member to form a seal between the removable lid in the closed position and the hollow member.

34. The system of claim 31, wherein the removable lid is hingedly connected to the hollow member.

35. A material container comprising:

a container including a dispensing opening; and a detachable dispensing system selectively connected to the container about the dispensing opening, the system comprising:

a handling portion having an outer ring configured to selectively secure and, alternatively, remove the handling portion about the dispensing opening of the container and an inner ring defining a circular aperture within the handling portion; a hollow member comprising a top end and a base end, the hollow member slideably disposed within the circular aperture and selectively positionable between a recessed position in which the top end is proximate the handling portion and the base end extends away from the handling portion and toward the container and, alternatively, an extended position in which the top end extends away from the handling portion and the container and the base end is substantially flush with either (i) the dispensing opening of the container or (ii) the inner ring of the handling portion, wherein the top end comprises a first engaging element for engaging at least a portion of the inner ring of the handling portion and preventing the top end of the hollow member from moving through the handling portion into the container when the hollow member is in the recessed position, and wherein the base end comprises a second engaging element for engaging at least a portion of the inner ring of the handling portion and fixing the hollow member to the handling portion when the hollow member is in the extended position; and an extendible spout at least partially disposed in the hollow member and connected to the hollow member, the extendible spout comprising, a proximal end and a proximal opening, the proximal end connected to the hollow member, a distal end and a distal opening, the distal end configured to extend from and retract at least partially into the hollow member, and a discharge passage that extends from the proximal opening to the distal opening, wherein the extendible spout is configured to dispense a pourable material from the container through the distal opening when the handling portion is engaged about the dispensing opening of the container.

36. The material container of claim 35, wherein the hollow member is substantially rigid.

* * * * *